US005827638A

United States Patent [19]

Tsukahara et al.

[11] Patent Number: 5,827,638

[45] Date of Patent: Oct. 27, 1998

[54] SILVER HALIDE PHOTOGRAPHIC LIGHT-SENSITIVE MATERIAL AND IMAGE FORMATION METHOD USING THE SAME

[75] Inventors: Jiro Tsukahara; Hideaki Satoh; Osamu Uchida; Toshio Kawagishi; Yasufumi Nakai, all of Minami Ashigara, Japan

[73] Assignee: Fuji Photo Film Co., Ltd., Kanagawa, Japan

[21] Appl. No.: 821,657

[22] Filed: Mar. 20, 1997

[30] Foreign Application Priority Data

Mar. 22, 1996 [JP] Japan ..... 8-066667

[51] Int. Cl.[6] ..... G03C 1/06

[52] U.S. Cl. ..... 430/505; 430/544; 430/956; 430/957; 430/958; 430/959; 430/960

[58] Field of Search ..... 430/505, 544, 430/956, 957, 958, 959, 960

[56] References Cited

U.S. PATENT DOCUMENTS

| | | | |
|---|---|---|---|
| 3,260,598 | 7/1966 | Yutzy et al. | 430/206 |
| 4,734,353 | 3/1988 | Ono et al. | 430/959 |
| 4,740,363 | 4/1988 | Hirai et al. | 423/641 |
| 4,740,453 | 4/1988 | Nakamura et al. | 430/959 |
| 4,857,444 | 8/1989 | Hirose et al. | 430/505 |
| 4,865,963 | 9/1989 | Furutachi et al. | 430/505 |
| 4,994,363 | 2/1991 | Koya et al. | 430/959 |
| 5,075,208 | 12/1991 | Watanabe et al. | 430/958 |
| 5,242,785 | 9/1993 | Morigaki et al. | 430/505 |

FOREIGN PATENT DOCUMENTS

| | | |
|---|---|---|
| 8-54705 | 2/1996 | Japan . |
| 8-54724 | 2/1996 | Japan . |

*Primary Examiner*—Hoa Van Le
*Attorney, Agent, or Firm*—Birch, Stewart, Kolasch & Birch, LLP

[57] ABSTRACT

A silver halide photographic light-sensitive material is described, which comprises a support having provided thereon a light-sensitive silver halide emulsion layer, wherein the silver halide photographic material contains a compound having been blocked by a metal chelate and capable of releasing a photographically useful compound therefrom through a reaction of the metal chelate moiety with a water-soluble chelating agent capable of forming a metal chelate having a higher stability constant on development. A method for forming an image is also described, which comprises processing, after imagewise exposure, a silver halide photographic light-sensitive material with a processing solution containing a nitrogen-containing heterocyclic carboxylic acid-base chelating agent.

22 Claims, No Drawings

SILVER HALIDE PHOTOGRAPHIC LIGHT-SENSITIVE MATERIAL AND IMAGE FORMATION METHOD USING THE SAME

FIELD OF THE INVENTION

The present invention relates to a silver halide light-sensitive material, more specifically, the present invention relates to a silver halide light-sensitive material capable of producing various photographically useful compounds on development and an image formation method using the same.

BACKGROUND OF THE INVENTION

Substances necessary for obtaining a photographic image or compounds for obtaining a photographic image of higher quality are called photographically useful compounds. The photographically useful compound is usually incorporated into a light-sensitive material or dissolved in a developer. Some photographically useful compounds are difficult to incorporate in a stable fashion into a light-sensitive material, or cause serious deterioration in the photographic capability if incorporated. These compounds are stabilized or rendered harmless by chemical modification and forced to exert the desired photographically useful activity by the demodification reaction on development.

Stabilization of the photographically useful compound by chemical modification and reactivation thereof by demodification are important for improving the photographic technique, however, methods highly available in general purpose use have not yet been established. This is because the chemical modification of the photographically useful compound must achieve stability sufficiently high to endure the long-term storage of a light-sensitive material and on the other hand, must smoothly allow occurrence of demodification reaction on development so that the photographically useful compound can exert its original activity, however, it is very difficult to satisfy these requirements.

JP-A-8-54705 and JP-A-8-54724 (the term "JP-A" as used herein means an "unexamined published Japanese patent application") disclose a technique of inactivating mercaptide into a sparingly soluble metal salt and liberating its original photographically useful activity by a ligand exchange reaction. This technique uses the property of mercaptide such that it forms a relatively stable and sparingly soluble complex with various metals, and satisfactory results are provided in achieving storage stability and rapidity of the demodification reaction. However, this method is bound to a technical limit such that the product is limited to mercaptide.

In the field of photographic science, the photo- graphically useful compound desired to be generated on development includes various compounds in addition to mercaptide. Accordingly, a method having high availability in general purpose use such that any photographically useful compound can be obtained according to the purpose, and a silver halide light-sensitive material to which such a method is applied have been conventionally demanded.

SUMMARY OF THE INVENTION

An object of the present invention is to provide a silver halide light-sensitive material to which a method for producing a photographically useful compound having high availability in general purpose use such that a desired photographically useful compound can be obtained on development is applied.

Another object of the present invention is to provide an image formation method using the above-described silver halide light-sensitive material.

These objects of the present invention can be attained by a silver halide photographic light-sensitive material comprising a support having provided thereon a light-sensitive silver halide emulsion layer, wherein said silver halide photographic light-sensitive material contains a compound having been blocked by a metal chelate and capable of releasing a photographically useful compound therefrom through a reaction of the metal chelate moiety with a water-soluble chelating agent capable of forming a metal chelate having a higher stability constant on development.

DETAILED DESCRIPTION OF THE INVENTION

The photographically useful compound (hereinafter, the "photographically useful compound" simply referred to indicates a photographically useful compound before it is blocked by a metal chelate), the compound which releases a photographically useful compound and the water-soluble chelating agent, which can be used in the present invention, are described in the order below.

The photographically useful compound for use in the present invention is described below.

The photographically useful compound for use in the present invention is a compound used on the premise that it is incorporated in the form of being blocked by a metal chelate into a light-sensitive material, and therefore, the compound is a photographically useful compound and at the same time, a chelate ligand to the metal. More specifically, the photographically useful compound for use in the present invention has such a structure that a photographically useful group having properties as a developing agent, an auxiliary developing agent, a development accelerator, an antifoggant, a fogging agent, a dye, an ultraviolet absorbent, a bleaching accelerator or a fixing accelerator, and a chelating group capable of chelating to a metal are present together. The photographically useful compound for use in the present invention may have a structure such that a photographically useful group and a chelating group are linked or that a photographically useful group constitutes a part or the whole of a chelating group.

Examples of the photographically useful group in the photographically useful compound for use in the present invention include photographically useful groups (those represented by the formula: PUG) described in U.S. Pat. 4,248,962, development inhibitors described in U.S. Pat. 4,477,563, dyes (the splitting-off group moiety released from couplers) described in JP-A-62-49353, and bleaching accelerators (the splitting-off group moiety released from couplers) described in JP-A-61-201247 and JP-A-2-55.

In the present invention, the photographically useful group is preferably a residue of a developing agent (e.g., catechol, hydroquinone, aminophenol, sulfonamidophenol, aminopyrazolone, phenylenediamine, ascorbic acid derivative), an auxiliary developing agent (e.g., 1-phenylpyrazolidin-3-one derivative), an antifoggant (e.g., β-acylhydrazine derivative), a development accelerator (e.g., mesoionic compound) or a development inhibitor (e.g., benzotriazole, 5-mercapto-tetrazole, 2-mercapto-1,3,4-thiadiazole derivative).

The chelating group in the photographically useful compound for use in the present invention is a group having from 2 to 6 coordinating groups. The coordinating group is a group having at least one atom (preferably a nitrogen atom or an oxygen atom) with a lone electron pair. Specific examples of the coordinating group include a nitrogen-containing heterocyclic residue (e.g., a residue obtained by removing a hydrogen atom from a nitrogen-containing heterocyclic ring such as pyridine, pyrazine, pyrimidine, piperidine, piperazine, oxazine, thiazine, quinoline, morpholine, pyrrole, imidazole, pyrazole, oxazole, thiazole, benzimidazole or indole), a carbonyl group, a carboxyl group, a hydroxyl group, an amino group, a hydroxyamino group, a hydrazino group, an imino group, oxime, hydrazone, an amido group, an imido group, hydrazide and a hydroxamic acid.

The chelating group in the photographically useful compound for use in the present invention is preferably a bidentate ligand, more preferably a bidentate ligand wherein one coordinating group is a group selected from a nitrogen-containing heterocyclic residue, an amino group and a hydroxyl group, and the other coordinating group is a carboxyl group. Specific examples thereof include aminocarboxylic acids such as glycine and anthranilic acid, nitrogen-containing heterocyclic carboxylic acids such as 2-pyridinecarboxylic acid, 2-pyrazine-carboxylic acid, 2-quinolinecarboxylic acid and 4,5-imidazole-dicarboxylic acid, and hydroxycarboxylic acids such as glycolic acid and salicylic acid.

The compound which releases the photographically useful compound for use in the present invention is described below.

The center metal in the compound which releases the photographically useful compound for use in the present invention is boron, magnesium, calcium, aluminum, manganese, iron, nickel, copper or zinc. The ratio of the photo- graphically useful compound to the metal atom in the chelate complex is determined by the number of coordinating groups in the photographically useful compound and the coordination number of the metal. For example, in the combination of a bidentate ligand and a four-coordinate metal, a 2:1 complex is usually formed, and in the combination of a bidentate ligand and a six-coordinate metal, a 3:1 complex is usually formed. Also, water may coordinate to form a hydrate or other chelating agent may coordinate to form a complex salt.

In the compound which releases the photographically useful compound for use in the present invention, the ring formed by the chelating group and the metal atom is a 5-, 6-, 7- or 8-membered ring, preferably a 5- or 6-membered ring. On coordination of the chelating group to the metal, a hydrogen ion may be released.

The compound which releases the photographically useful compound for use in the present invention must be extremely low active. The low activation may be provided in any manner. For example, a case where the metal chelate is extremely sparingly soluble, a case where the active site of the photographically useful group is masked by a metal ion, or a case where the compound is converted into a metal chelate to undergo outstanding change in the hydrophilicity or hydrophobicity, may be used.

The compound which releases the photographically useful compound for use in the present invention is preferably represented by formula (I), more preferably formula (II):

$$(PL)_n \cdot M \cdot L_k \quad \text{(I)}$$

$$(PUG\text{-}LINK\text{-}LIG)_n \cdot M \cdot L_k \quad \text{(II)}$$

wherein PL represents a photographically useful group having chelating ability, PUG represents a photographically useful group, LINK represents a single bond or a divalent linking group, LIG represents a chelating group, M represents magnesium, aluminum, calcium, nickel, copper or zinc, L represents a chelate ligand, n represents an integer of from 1 to 3, k represents 0 or an integer of 1 or 2, and the sum of n an k does not exceed 3.

In formula (I), PL is a photographically useful group having chelating ability, and preferred examples thereof include groups derived from the following compounds. The photographically useful group represented by PL may have a substituent and examples of the substituent are the same as those described below for PUG.

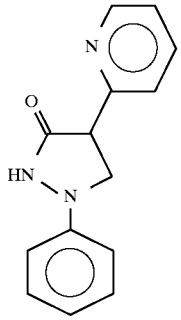

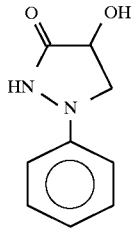

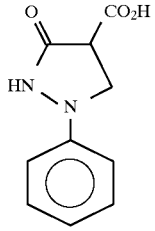

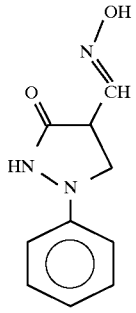

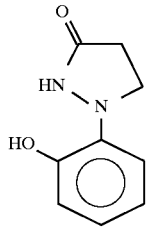

-continued

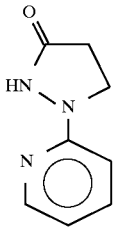

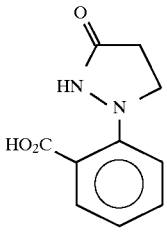

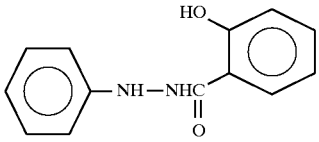

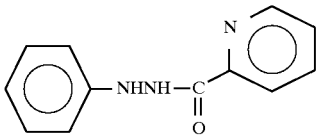

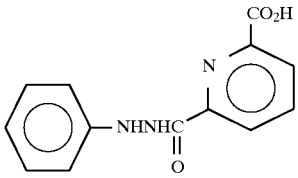

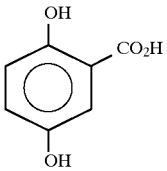

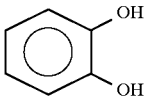

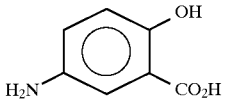

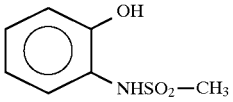

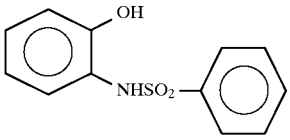

In formula (II), PUG is a photographically useful group and preferred examples thereof include the following compound residues. The photographically useful group represented by PUG may have a substituent and examples of the substituent include an alkyl group (e.g., methyl, ethyl, isobutyl, n-dodecyl, cyclohexyl), an aryl group (e.g., phenyl, naphthyl), a heterocyclic group (e.g, pyridyl, thienyl, furyl, imidazolyl, oxazolyl, indolyl, benzothiazolyl), a halogen atom (e.g., fluorine, chlorine, bromine), an alkoxy group (e.g., methoxy, ethoxy, benzyloxy), an aryloxy group (e.g., phenoxy), an alkylthio group (e.g., methylthio, ethylthio), an arylthio group (e.g., phenylthio), a hydroxyl group, a nitro group, a cyano group, an amido group (e.g., acetylamino, benzoylamino), a sulfonamido group (e.g., methanesulfonylamino, benzene- sulfonylamino), a ureido group, an ester group (e.g., acetoxy, benzoyloxy, methoxycarbonyl, phenoxycarbonyl), a carbamoyl group (e.g., N-methylcarbamoyl, N,N-diphenylcarbamoyl), a sulfamoyl group (e.g., N-phenylsulfamoyl), an acyl group (e.g., acetyl, benzoyl), an amino group (e.g., amino, methylamino, anilino, - diphenylamino), a sulfonyl group (e.g., methylsulfonyl), a carboxyl group and a sulfo group. A substituent may further be present on the carbon atom of the substituent.

Examples of PUG are set forth below. The mark * indicates the site bonding to LINK.

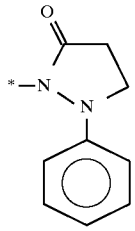

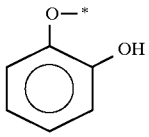

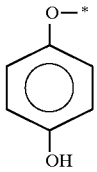

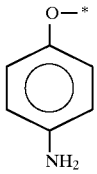

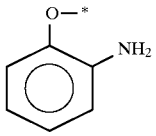

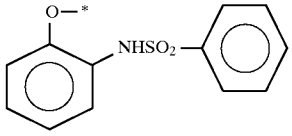

-continued
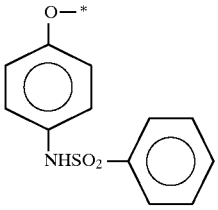
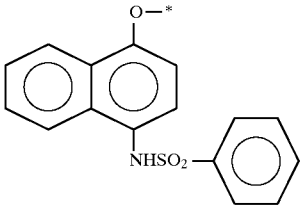
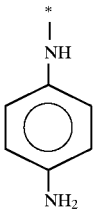
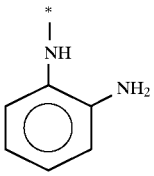
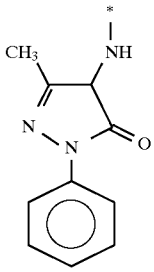
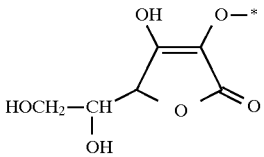
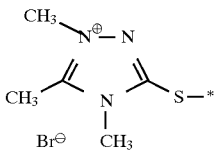
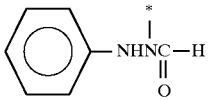
-continued
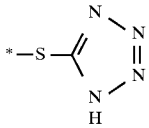
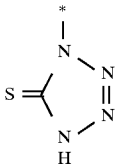
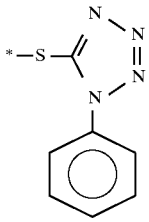
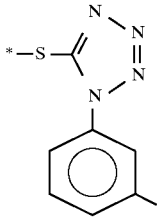
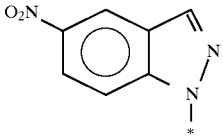
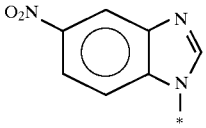
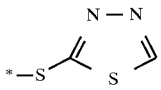
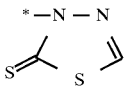
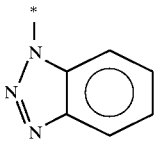
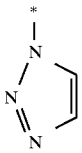

-continued

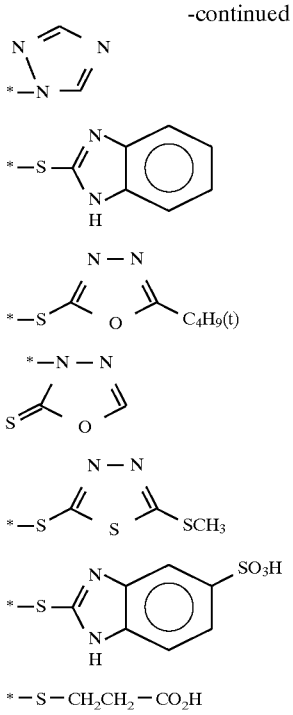

In formula (II), LINK represents a single bond or a divalent linking group. Preferred examples of the linking group include an ether bond, an alkylene group (e.g., methylene, ethylene, xylylene), an arylene group (e.g, phenylene), the following divalent groups, and a divalent group where a plurality of divalent groups are bonded in series. These groups each may be substituted by the same substituent as described for PUG.

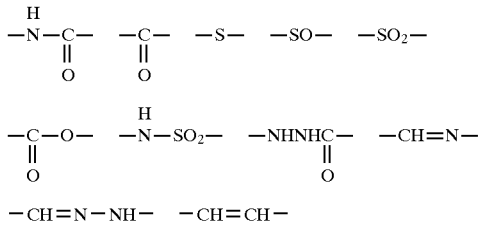

In formula (II), LIG represents a chelating group and preferred examples thereof include groups obtained by removing hydrogen atoms other than the hydrogen atom at the active site, from the following compounds. The groups each may have the same substituent as described for PUG.

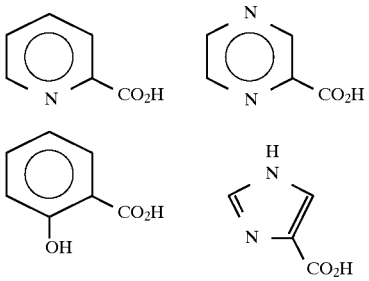

-continued

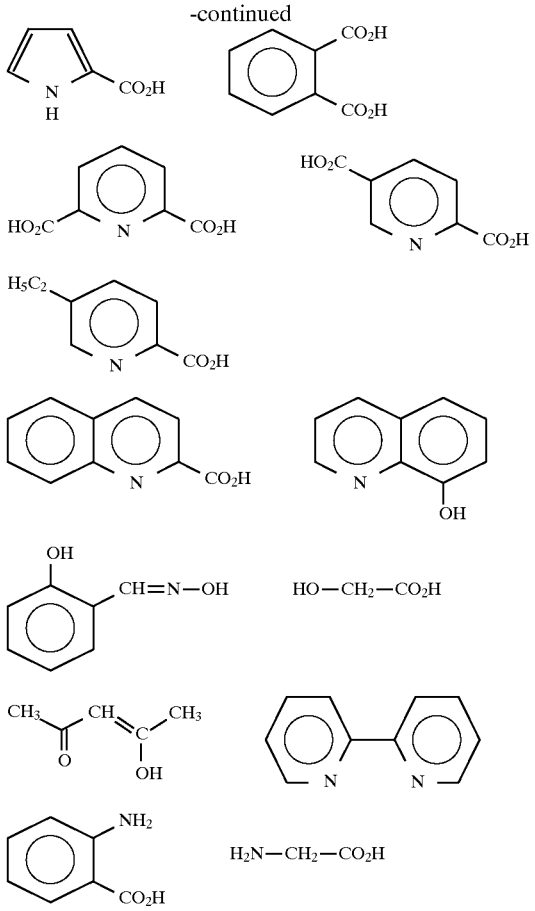

In formulae (I) and (II), M is magnesium, aluminum, calcium, nickel, copper or zinc, preferably zinc.

In formulae (I) and (II), L is a mere chelate ligand having no photographically useful group. L has almost the same meaning as LIG and to say strictly, L is a compound resulting from adding hydrogen to the chelating group defined by LIG.

In formulae (I) and (II), n represents an integer of from 1 to 3 and k represents 0 or an integer of 1 or 2. The sum of n and k does not exceed 3. n is preferably 1 or 2, and k is preferably 0 or 1. The most preferred combination is such that n is 2 and k is 0.

Preferred examples for formulae (I) and (II) are described in the foregoing and of course, combinations of preferred examples are particularly preferred. More specifically, when PUG, LINK, LIG and PL each is a group described as a preferred example, M is zinc, n is 2, and k is 0, the compounds exhibit most preferred properties.

Preferred specific examples of the compound which releases the photographically useful compound for use in the present invention are set forth below, however, the present invention is by no means limited thereto.

(1)
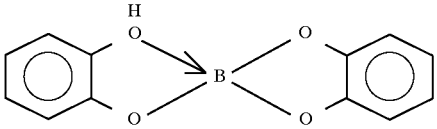
(2)
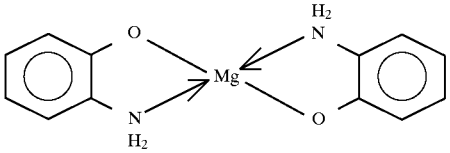
(3)
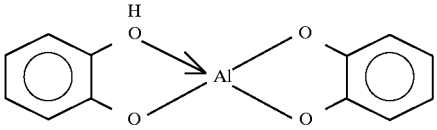
(4)
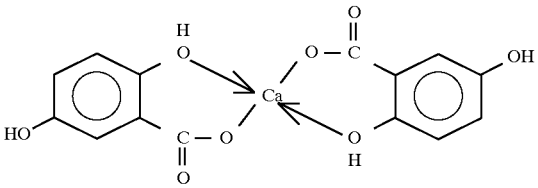
(5)
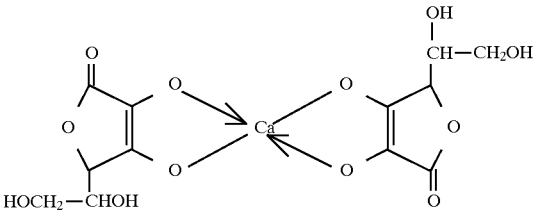
(6)
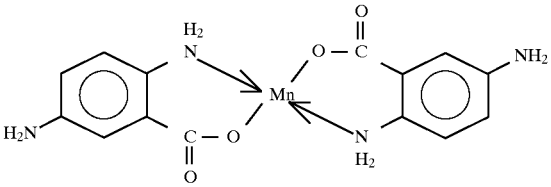
(7)
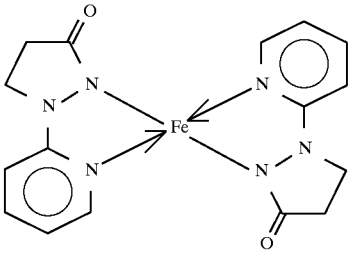
(8)
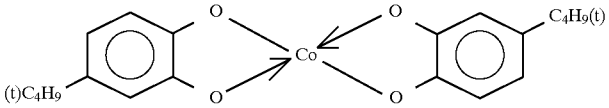
(9)
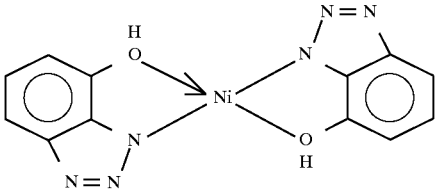

-continued
(10)
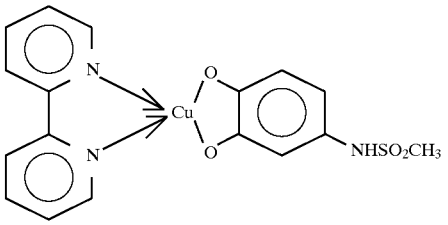
(11)
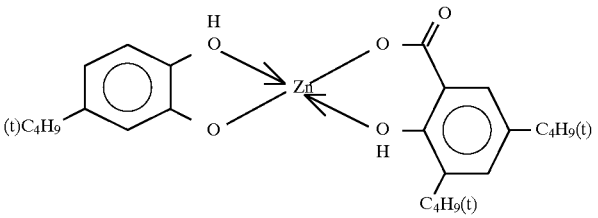
(12)
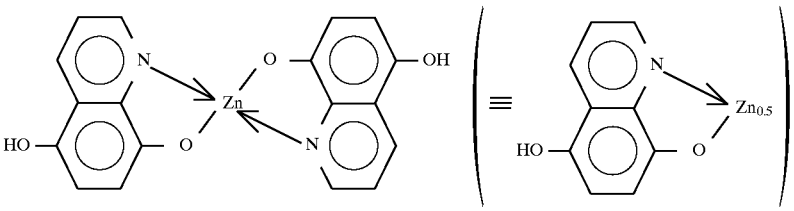
(13)
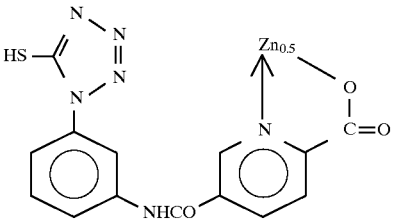
(14)
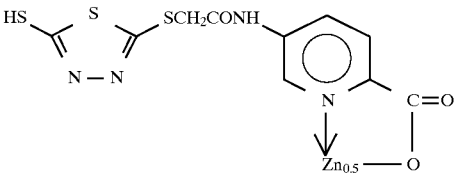
(15)
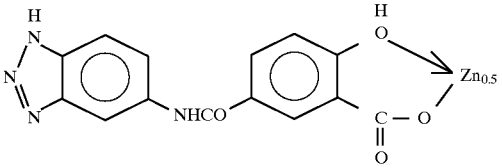
(16)
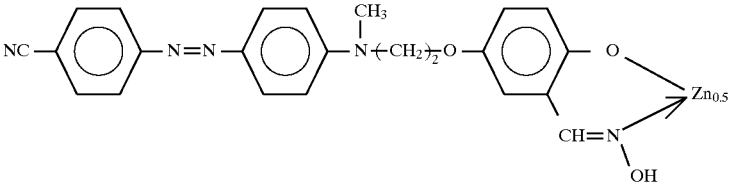
(17)
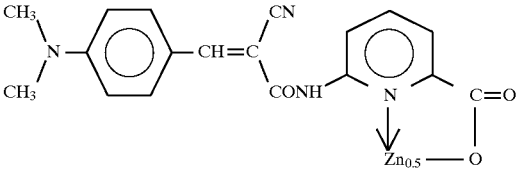

-continued
(18)
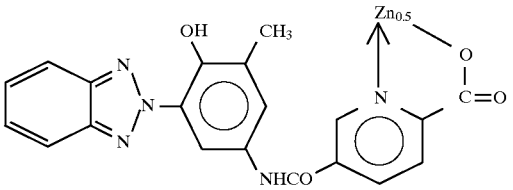
(19)
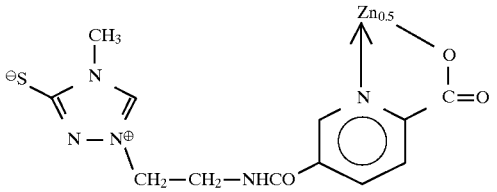
(20)
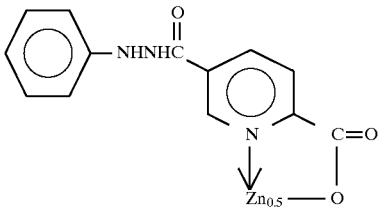
(21)
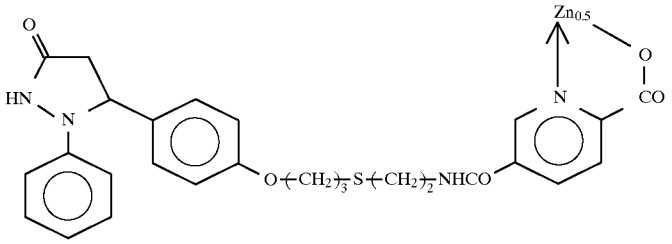
(22)
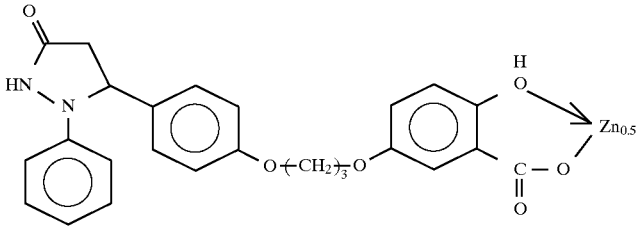
(23)
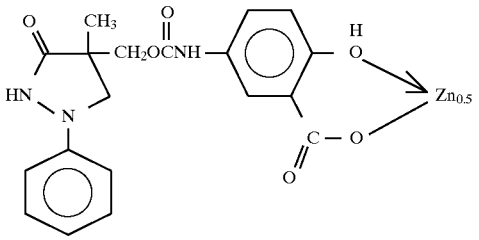
(24)
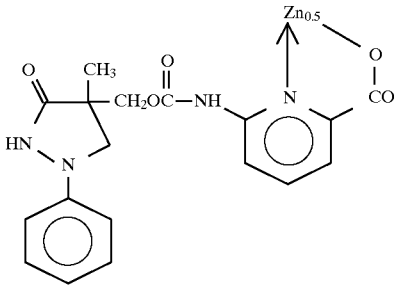

-continued
(25)
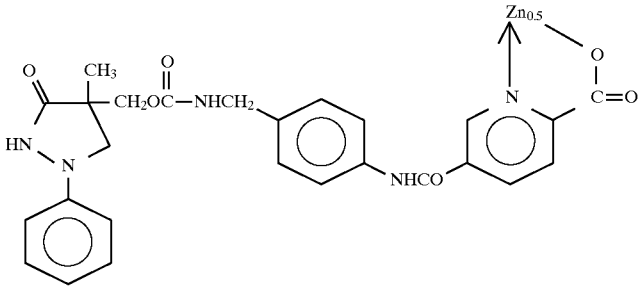
(26)
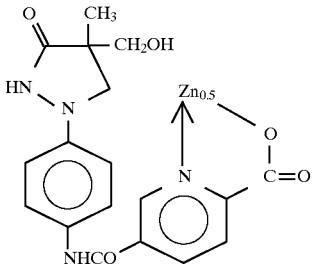
(27)
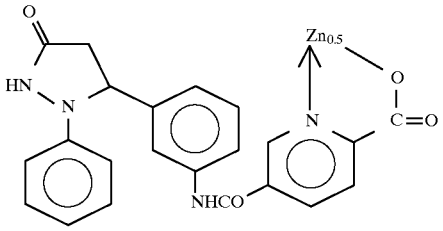
(28)
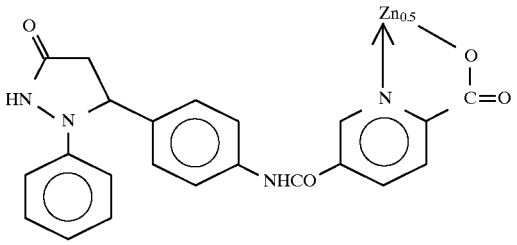
(29)
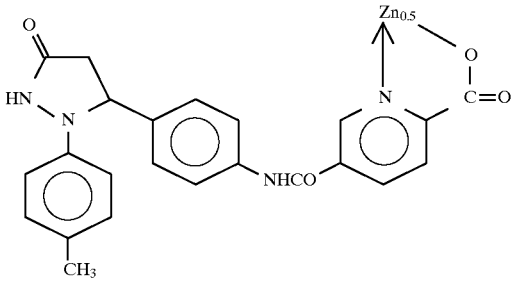
(30)
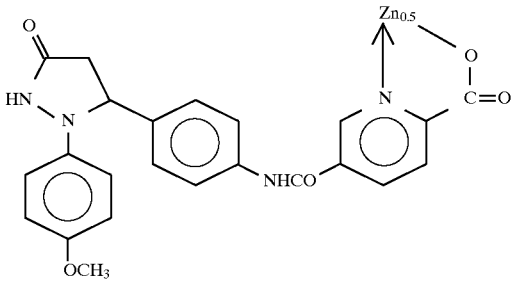

-continued (31)

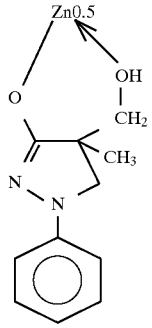

(32)

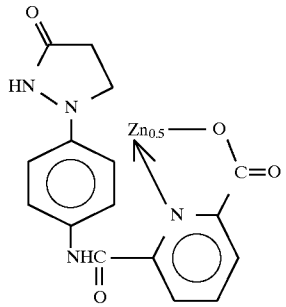

Synthesis examples of the compound which releases the photographically useful compound for use in the present invention are described below.

SYNTHESIS EXAMPLE 1

Synthesis of Compound (11)

Compound (11) for use in the present invention is synthesized according to the method described in Example 1 of U.S. Pat. No. 5,290,651, column 10.

SYNTHESIS EXAMPLE 2

Synthesis of Compound (27)

While mixing and stirring 193 g of 3-nitrocinnamic acid, 2 ℓ of methanol and 50 g of concentrated sulfuric acid, the mixture was heated under reflux for 2 hours. The reaction solution was poured into water and the crystals obtained were filtered. To a reaction solution under heat-refluxing while mixing and stirring 2 ℓ of 2-propanol, 200 ml of water, 20 g of ammonium chloride and 200 g of reduced iron, the crystals obtained above were gradually added, and the solution was further heated under reflux for one hour. The reaction solution still being hot was filtered, the filtrate was poured into 10 ℓ of water, and the crystals (methyl 3-aminocinnamate) obtained were collected by filtration. Yield: 108 g.

193 g of methyl 3-aminocinnamate and 900 ml of formic acid were mixed and heated under reflux for 2 hours. The reaction solution was poured into water and the crystals (methyl 3-formamidocinnamate) obtained were collected by filtration. Yield: 127 g.

108 g of phenylhydrazine, 205 g of methyl 3-formamidocinnamate, 200 ml of a 28% methanol solution of sodium methoxide and 400 ml of acetonitrile were mixed and heated under reflux for 1 hour in a nitrogen stream. 2 ℓ of the reaction solution was poured into water and 100 ml of concentrated hydrochloric acid was added. Then, precipitate was produced. The precipitate was collected by filtration and recrystallized from acetonitrile to obtain 99 g of 1-phenyl-5-(3-formamidophenyl) pyrazolidin-3-one as white crystals.

140 g of 1-phenyl-5-(3-formamidophenyl)pyrazolidin-3-one obtained above, 600 ml of methanol and 40 of concentrated hydrochloric acid were mixed and the mixture was heated at 45° C. for 3 hours while stirring. The resulting solution was poured into water to obtain 88 g of 1-phenyl-5-(3-aminophenyl) pyrazolidin-3-one.

167 g of 2,5-pyridinecarboxylic acid, 2 ℓ of methanol and 30 g of concentrated sulfuric acid were mixed and the mixture was heated under reflux until the solution became homogeneous (2 hours). The reaction solution was poured into 5 ℓ of water to obtain 82 g of 2,5-pyridinecarboxylic acid-2-methyl ester as pale yellow crystals.

46 g of 2,5-pyridinecarboxylic acid-2-methyl ester obtained above and 300 ml of acetonitrile were mixed and while stirring the mixture at room temperature, 35 g of oxalyl chloride was added dropwise over 30 minutes. After stirring the resulting solution at room temperature for 2 hours, the solvent and oxalyl chloride were distilled off under reduced pressure to obtain 2,5-pyridinecarboxylic acid-2-methyl-5-chloride.

While stirring 63 g of 1-phenyl-5-(3-aminophenyl)-pyrazolidin-3-one synthesized above and 300 ml of N,N-dimethylacetamide at 10° C., the entire amount of 2,5-pyridinecarboxylic acid-2-methyl-5-chloride synthesized above was gradually added. The reaction solution was poured into water, extracted with ethyl acetate, dried and filtered and the solvent was distilled off to obtain an oily product. This product was purified in silica gel column chromatography (eluate: hexane:ethyl acetate =2:1) to obtain 80 g of a methyl ester form (1-phenyl-5-[3-(2-methoxycarbonylpyridine-5-carbonamido) phenyl] pyrazolidin-3-one).

42 g of the methyl ester form obtained above and 400 ml of methanol were mixed and thereto, an aqueous solution containing 7.2 g of lithium hydroxide was added dropwise at 50° C. and heated while stirring for 3 hours in a nitrogen stream. After allowing the solution to cool, 11 g of zinc acetate dihydrate was added and then, crystals of Compound (27) for use in the present invention deposited were collected by filtration. Yield: 38 g.

SYNTHESIS EXAMPLE 3

Synthesis of Compound (28)

Compound (28) was synthesized in the same manner as in Synthesis Example 2 except for using 4-nitrocinnamic acid in place of 3-nitrocinnamic acid.

SYNTHESIS EXAMPLE 4

Synthesis of Compounds (29) and (30)

Compounds (29) and (30) were synthesized in the same manner as in Synthesis Example 3 except for using p-tolylhydrazine or p-methoxyphenylhydrazine in place of phenylhydrazine.

The water-soluble chelating agent for use in the present invention is described below.

The water-soluble chelating agent for use in the present invention may be one known as a chelating agent in the analytical chemistry or as a hard water softening agent in the photographic chemistry. These are described in A. E. Martel and R. M Smith, *Critical Stability Constant*, and A. Lingbom (translated by Nobuyuki Tanaka and Haruko Sugi), *Saku Keisei Han'no (Complex Formation Reaction)*, Sangyo Tosho. Further, the water-soluble chelating agent as a complexing agent is described in JP-A-62-129848 and EP-A-210660.

The water-soluble chelating agent for use in the present invention preferably has water solubility to such an extent that at least $1\times10^{-3}$ mol/ℓ (preferably $1\times10^{-2}$ mol/ℓ) of an aqueous solution can be prepared.

Preferred examples of the water-soluble chelating agent for use in the present invention include an aminopolycarboxylic acid (e.g., iminodiacetic acid, nitrilotriacetic acid, N-(2-carboxyphenyl) iminodiacetic acid, ethylenediaminetetraacetic acid, 1,3-diaminopropanetetraacetic acid, diethylene triaminepentaacetic acid) and a nitrogen-containing heterocyclic carboxylic acid (e.g., 2-pyridinecarboxylic acids, 2-pyrazinecarboxylic acid, imidazole-4,5-dicarboxylic acid). Among these, the nitrogen-containing heterocyclic carboxylic acid is preferred, and 2-pyridinecarboxylic acids represented by formula (III) are more preferred.

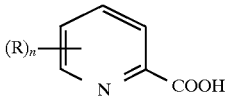

(III)

wherein R represents an alkyl group having from 1 to 4 carbon atoms (e.g., methyl, ethyl, isobutyl), a sulfo group, a hydroxyl group, a carboxyl group, an amino group, an alkoxy group having from 1 to 12 carbon atoms (e.g., methoxy, butoxy, dodecyloxy) or an amido group having from 1 to 6 carbon atoms (e.g., acetylamino, pivaloylamino), and n represents 0 or an integer of from 1 to 4. R is preferably a carboxyl group and n is preferably 0 or 1.

The photographically useful compound blocked by a metal chelate for use in the present invention can be added to an emulsion layer or other photographic constituent layer of a silver halide light-sensitive material. The preferred range of the addition amount varies depending on the photographically useful compound to be produced, however, the compound is added typically in an amount of from $1\times10^{-5}$ to $5\times10^{-2}$ mol/m$^2$, preferably from $1\times10^{-4}$ to $1\times10^{-2}$ mol/m$^2$.

The development processing method of the silver halide light-sensitive material of the present invention is described below.

The silver halide light-sensitive material of the present invention is processed with a developer containing the water-soluble chelating agent for use in the present invention or developed by the method of laminating with sheet containing the water-soluble chelating agent for use in the present invention which is dissolved or transferred using water as a medium.

At this time, a desired photographically useful compound is considered to be generated by the ligand exchange reaction between the metal chelate in the photographically useful compound for use in the present invention and the water-soluble chelating agent for use in the present invention. In other words, the water-soluble chelating agent plays a role of depriving the metal from the photographically useful compound which is inactivated by converting it into a metal chelate, to reactivate the compound.

The water-soluble chelating agent for use in the present invention must have coordination ability to the metal chelated by the photographically useful compound for use in the present invention, equal to or higher than that of the photographically useful compound for use in the present invention. This is very important in the present invention. The coordination ability of respective compounds is determined by the stability constant of the metal chelate produced and the publication, *Critical Stability Constant* (supra) may be referred to.

The water-soluble chelating agent for use in the present invention exhibits a faster production rate of the photographically useful compound as it is used in a higher concentration. The water-soluble chelating agent for use in the present invention is preferably used in a concentration of from $1\times10^{-3}$ to $5\times10^{-1}$ mol/ℓ, more preferably from $5\times10^{-3}$ to $2\times10^{-1}$ mol/ℓ, still more preferably from $1\times10^{-2}$ to $1\times10^{-1}$ mol/ℓ.

In incorporating the compound for use in the present invention into a light-sensitive material, the methods (e.g., solid fine particle dispersion, oil-in-water dispersion, latex dispersion) similar to the dispersion method of a hydrophobic compound such as a coupler, which will be described later, may be used according to the property of the compound or the object.

The present invention can be applied to various color light-sensitive materials such as color negative film for general use or for movie, color reversal film for slide or for television, color paper, color positive film and color reversal paper. Further, the present invention is suitably used for a film unit with a lens described in JP-B-2-32615 (the term "JP-B" as used herein means an "examined Japanese patent publication") and JP-B-U-3-39784 (the term "JP-B-U" as used herein means an "examined Japanese utility model publication"). Further, the present invention may be applied to a diffusion transfer system color photograph using heat development, a diffusion transfer photograph using an autopositive emulsion or a wet reversal color copying material using an autopositive emulsion. Furthermore, the present invention may be applied to a black-and-white light-sensitive material such as black-and-white negative film, micro film and X-ray film. Among these, a color or black-and-white light-sensitive material for general use is preferred.

When the present invention is applied to a color light-sensitive material, it may suffice if at least one light-sensitive layer is provided on a support. A typical example thereof is a silver halide photographic light-sensitive material comprising a support having thereon at least one light-sensitive layer consisting of a plurality of silver halide emulsion layers having substantially the same spectral sensitivity but different in the light sensitivity. The light-sensitive layer includes a unit light-sensitive layer having spectral sensitivity to any of blue light, green light and red light. In the case of a multi-layer silver halide color photographic light-sensitive material, the arrangement of unit light-sensitive layers are generally such that a red-sensitive layer, a green-sensitive layer and a blue-sensitive layer are provided in this order from the support side. However, depending on the purpose, the above-described arrangement order may be reversed or a layer different in the spectral sensitivity may be interposed between layers having the same spectral sensitivity. A light-insensitive layer may be provided between the above-described silver halide light-sensitive layers or as the uppermost layer or the lowermost layer. These layers may contain a coupler, a DIR compound or a color mixing inhibitor which will be described later, or may contain a compound which releases imagewise or reverse imagewise a dye to cause difference in diffusibility between the dye released and the compound before the release.

A plurality of silver halide emulsion layers constituting each unit light-sensitive layer are preferably arranged such that two layers of a high-sensitivity emulsion layer and a low-sensitivity emulsion layer are provided so that the light sensitivity can be lowered in sequence towards the support, as described in German Patent 1,121,470 and British Patent 923,045. Further, it is also possible to provide a low-sensitivity emulsion layer farther from the support and a high-sensitivity emulsion layer nearer to the support, as described in JP-A-57-112751, JP-A-62-200350, JP-A-62-206541 and JP-A-62-206543.

Specific examples of the layer arrangement include an order, from the farthest side from the support, of a low-sensitivity blue-sensitive layer (BL)/a high-sensitivity blue-sensitive layer (BH)/a high-sensitivity green-sensitive layer (GH)/a low-sensitivity green-sensitive layer (GL)/a high-sensitivity red-sensitive layer (RH)/a low-sensitivity red-sensitive layer (RL), an order of BH/BL/GL/GH/RH/RL and an order of BH/BL/GH/GL/RL/RH.

Also, as described in JP-B-55-34932, a blue-sensitive layer/GH/RH/GL/RL may be arranged in this order from the farthest side from the support. Further, as described in JP-A-56-25738 and JP-A-62-63936, a blue-sensitive layer/GL/RL/ may be arranged in this order from the farthest side from the support.

An arrangement constituted by three layers different in light sensitivity may be used as described in JP-B-49-15495 where a silver halide emulsion layer having the highest light sensitivity is provided as an upper layer, a silver halide emulsion layer having light sensitivity lower than that of the upper layer is provided as a medium layer and a silver halide emulsion layer having light sensitivity lower than that of the medium layer is provided as a lower layer so that the light sensitivity can be lowered in sequence towards the support. Even in the case of arrangement constituted by these three layers different in light sensitivity, as described in JP-A-59-202464, a medium-sensitivity emulsion layer/a high-sensitivity emulsion layer/a low-sensitivity emulsion layer may be provided in this order from the farther side from the support in the layer having the same spectral sensitivity.

In addition, an order of a high-sensitivity emulsion layer/a low-sensitivity emulsion layer/a medium-sensitivity emulsion layer or an order of a low-sensitivity emulsion layer/a medium-sensitivity emulsion layer/a high-sensitivity emulsion layer may also be used.

In the case of a four or more layer structure, the layer arrangement may also be changed as described above.

In order to improve color reproducibility, a donor layer (CL) having a spectral sensitivity distribution different from that of main light-sensitive layers such as BL, GL and RL and capable of giving an interlayer effect, is preferably provided adjacent to or in the vicinity of a main light-sensitive layer, as described in U.S. Pat. Nos. 4,663,271, 4,705,744 and 4,707,436, JP-A-62-160448 and JP-A-63-89850.

When the photographic light-sensitive material of the present invention is a color negative film or a color reversal film, the silver halide contained in the photographic emulsion layer is preferably silver iodobromide, silver iodochloride or silver iodochlorobromide having a silver iodide content of about 30 mol% or less, more preferably silver iodobromide or silver iodochlorobromide having a silver iodide content of from about 2 mol% to about 25 mol%.

When the photographic light-sensitive material of the present invention is a direct positive color light-sensitive material, the silver halide contained in the photographic emulsion layer is preferably silver chlorobromide or silver bromide.

When the photographic light-sensitive material of the present invention is a color printing paper, the silver halide contained in the photographic emulsion layer is preferably silver chlorobromide or silver chloride containing substantially no silver iodide. The term "contain substantially no silver iodide" as used herein means that the silver iodide content is 1 mol% or less, preferably 0.2 mol% or less. The silver chlorobromide emulsion may have a halogen composition in any silver bromide/silver chloride ratio. The ratio may be selected over a wide range, however, the silver chloride ratio is preferably 2 mol% or more. The light-sensitive material suitable for rapid processing preferably uses a so-called high silver chloride emulsion having a high silver chloride content. The high silver chloride emulsion preferably has a silver chloride content of 90 mol% or more, more preferably 95 mol% or more. For the purpose of reducing the replenishing amount of the development processing solution, a silver chlorobromide emulsion comprising nearly pure silver chloride, more specifically, having a silver chloride content of from 98 to 99.9 mol%, is preferably used.

The silver halide grain in the photographic emulsion may have a regular crystal from such as cubic, octahedral or tetradecahedral form, an irregular crystal form such as spherical or platy form, a crystal defect such as twin, or a composite form of these.

The silver halide may be a fine grain having a grain size of about 0.2 $\mu$m or less or a large-sized grain having a grain size in terms of a projected area diameter up to about 10 $\mu$m, and either a polydisperse emulsion or a monodisperse emulsion may be used.

The term "equivalent-circle diameter" as used hereinafter means a diameter of a circle having the same area as the projected area of a grain. The term "equivalent-sphere diameter" as used hereinafter means a diameter of a sphere having the same volume as the volume of a grain.

The silver halide photographic emulsion which can be used in the present invention can be prepared according to the methods described, for example, in *Research Disclosure* (herein-after simply referred to as "RD") No. 17643, pp. 22–23, "I. Emulsion Preparation and Types" (December, 1978), ibid., No. 18716, p. 648 (November, 1979), ibid., No. 307105, pp. 863–865 (November, 1989), P. Glafkides, *Chemie et Phisigue Photo-graphigue*, Paul Montel (1967), G. F. Duffin, *Photographic Emulsion Chemistry*, The Focal Press (1966), and V. L. Zelikman et al., *Making and Coating Photographic Emulsion*, The Focal Press (1964).

The monodisperse emulsions described in U.S. Pat. Nos. 3,574,628 and 3,655,394 and British Patent 1,413,748 are also preferably used.

Further, tabular grains having an aspect ratio of about 3 or more can be used in the present invention. The tabular grain can be easily prepared by the methods described in Gutoff, *Photoqraphic Science and Engineerinq*, Vol. 14, pp. 248–257 (1970), U.S. Pat. Nos. 4,434,226, 4,414,310, 4,433,048 and 4,439,520 and British Patent 2,112,157.

The crystal structure may be homogeneous, may be different in the halogen composition between the interior and the exterior or may have a layer structure. A silver halide having a different composition may be conjugated thereto by epitaxial junction or the silver halide may be conjugated with a compound other than silver halide, such as silver rhodanate or lead oxide. Also, a mixture of grains having various crystal forms may be used.

The above-described emulsion may be a superficial latent image-type emulsion forming a latent image mainly on the surface, an internal latent image-type emulsion forming a latent image inside the grain, or an emulsion of a type forming a latent image both on the surface of and inside the grain. The emulsion may be either a negative type emulsion or a positive type emulsion (so-called autopositive emulsion). The negative type emulsion may be either a usual emulsion or a heat developable emulsion. The internal latent image-type emulsion may be a core/shell internal latent image-type emulsion described in JP-A-63-264740 and the preparation method of this emulsion is described in JP-A-59-133542. In this emulsion, the thickness of the shell varies depending upon the development processing or the like, but it is preferably from 3 to 40 nm, more preferably from 5 to 20 nm.

The silver halide emulsion is usually subjected to physical ripening, chemical ripening and spectral sensitization before use. The additives used in these steps are described in RD No. 17643, RD No. 18716 and RD No. 307105 and the pertinent portions thereof are summarized in the table set forth later.

The light-sensitive material of the present invention may use a mixture of two or more kinds of emulsions different at least in one property of the light-sensitive silver halide emulsion, such as the grain size, the grain size distribution, the halogen composition, the grain shape or the sensitivity, in the same layer.

It is preferred to apply a silver halide grain with the grain surface being fogged described in U.S. Pat. No. 4,082,553, a silver halide grain with the grain inside being fogged described in U.S. Pat. No. 4,626,498 and JP-A-59-214852 or a colloidal silver to a light-sensitive silver halide emulsion layer and/or a substantially light-insensitive hydrophilic colloid layer. The term "silver halide grain with the grain inside or surface being fogged" as used herein means a silver halide grain which can be uniformly (non-imagewise) developed irrespective of an unexposed area or an exposed area of the light-sensitive material. The preparation method of such a grain is described in U.S. Pat. No. 4,626,498 and JP-A-59-214852. The silver halide forming the inside nucleus of a core/shell type silver halide grain with the grain inside being fogged may have a different halogen composition. The silver halide with the grain inside or surface being fogged may be any of silver chloride, silver chlorobromide, silver iodobromide and silver chloroiodobromide. The fogged silver halide grain has an average grain size of preferably from 0.01 to 0.75 $\mu$m, more preferably from 0.05 to 0.6 $\mu$m. The grain may have a regular form or may be a polydisperse emulsion, but it is preferably monodisperse (namely, at least 95% by weight or by number of silver halide grains having a grain size falling within the average grain size ±40%).

In the present invention, a light-insensitive fine grain silver halide is preferably used. The term "light-insensitive fine grain silver halide" as used herein means a silver halide fine grain which is not sensitive to light at the time of imagewise exposure for obtaining a dye image and substantially not developed at the time of development process. The light-insensitive fine grain silver halide is preferably not fogged previously. The fine grain silver halide has a silver bromide content of from 0 to 100 mol% and may contain, if desired, silver chloride and/or silver iodide. It preferably contains from 0.5 to 10 mol% of silver iodide. The fine grain silver halide has an average grain size (an average of equivalent-circle diameters of the projected area) of preferably from 0.01 to 0.5 $\mu$m, more preferably from 0.02 to 0.2 $\mu$m.

The fine grain silver halide can be prepared by the same method as that for the normal light-sensitive silver halide. The surface of the silver halide grain neither needs be optically sensitized nor be spectrally sensitized. However, it is preferred to add a known stabilizer such as a triazole-base compound, an azaindene-base compound, a benzothiazolium-base compound, a mercapto-base compound or a zinc compound, to the fine grain silver halide in advance of the addition to a coating solution. A layer containing the fine grain silver halide grain may contain colloidal silver.

The light-sensitive material of the present invention preferably has a coated silver amount of 6.0 g/m$^2$ or less, most preferably 4.5 g/$^2$ or less.

The photographic additives which can be used in the present invention are also described in RDs and the portions having the pertinent description are shown in the table below.

| Kinds of Additives | RD17643 | RD18716 | RD307105 |
|---|---|---|---|
| 1. Chemical sensitizer | p. 23 | p. 648, right col. | p. 866 |
| 2. Sensitivity increasing agent | | p. 648, right col. | |
| 3. Spectral sensitizer, supersensitizer | pp. 23–24 | p. 648, right col.-p. 649, right col. | pp. 866–868 |
| 4. Whitening agent | p. 24 | p. 647, right col. | p. 868 |
| 5. Light absorbent, filter dye, UV absorbent | pp. 25–26 | p. 649, right col.-p. 650, left col. | p. 873 |
| 6. Binder | p. 26 | p. 651, left col. | pp. 873–874 |
| 7. Plasticizer, lubricant | p. 27 | p. 650, right col. | p. 876 |
| 8. Coating aid, surface active agent | pp. 26–27 | p. 650, right col. | pp. 875–876 |
| 9. Antistatic agent | p. 27 | p. 650, right col. | pp. 876–877 |
| 10. Matting agent | | | pp. 878–879 |

Various dye-forming couplers can be used in the light-sensitive material of the present invention and the following couplers are particularly preferred.

Yellow Coupler

Couplers represented by formula (I) or (II) of EP-A-502424; couplers represented by formula (1) or (2) (particularly, Y-28 at page 18) of EP-A-513496; couplers represented by formula (I) in claim 1 of EP-A-568037; couplers represented by formula (I) in column 1, lines 45 to 55 of U.S. Pat. 5,066,576; couplers represented by formula (I) in paragraph 0008 of JP-A-4-274425; couplers (particularly, D-35 at page 18) described in claim 1 at page 40 of EP-A-498381; couplers represented by formula (Y) at page 4 (particularly, Y-1 (page 17) and Y-54 (page 41)) of EP-A-447969; couplers represented by formula (II), (III) or (IV) in column 7, lines 36 to 58 (particularly, II-17, II-19 (column 17) and II-24 (column 19)) of U.S. Pat. No. 4,476,219;

Magenta Coupler

Compounds L-57 (page 11, right lower column), L-68 (page 12, right lower column) and L-77 (page 13, right lower column) of JP-A-3-39737; Compounds [A-4]-63 (page 134), [A-4]-73 and [A-4]-75 (page 139) of EP-A-456257, Compounds M-4, M-6 (page 26) and M-7 (page 27) of EP-A-486965; Compound M-45 (page 19) of EP-A-571959; Compound M-1 (page 6) of JP-A-5-204106; Compound M-22 in paragraph 0237 of JP-A-4-362631;

Cyan Coupler

Compounds CX-1, CX-3, CX-4, CX-5, CX-11, CX-12, CX-14 and CX-15 (pages 14 to 16) of JP-A-204843; Compounds C-7, C-10 (page 35), C-34, C-35 (page 37), (I-1) and (I-17) (pages 42 and 43) of JP-A-4-43345; couplers represented by formula (Ia) or (Ib) in claim 1 of JP-A-6-67385; and Polymer Coupler Compounds P-1 and P-5 (page 11) of JP-A-2-44345

Coupler Which Provides A Colored Dye Having An Appropriate

Diffusibility

Those described in U.S. Pat. No. 4,366,237, British Patent 2,125,570, EP-B-96873 and German Patent 3,234,533 are preferred.

Coupler For Correcting Unnecessary Absorption Of A Colored Dye

Yellow colored cyan couplers represented by formula (CI), (CII), (CIII) or (CIV) described at page 5 of EP-A-456257 (particularly, Compound YC-86 at page 84); Yellow Colored Magenta Couplers ExM-7 (page 202), EX-1 (page 249) and EX-7 (page 251) described in EP-A-456257; Magenta Colored Cyan Couplers CC-9 (column 8) and CC-13 (column 10) described in U.S. Pat. No. 4,833,069; and colorless masking couplers represented by formula (2) (column 8) of U.S. Pat. No. 4,837,136 or formula (A) in claim 1 of WO92/11575 (particularly, compounds described at pages 36 to 45) are preferred.

Compounds (including couplers) which release a photographically useful compound residue upon reaction with an oxidation product of a developing agent are described below.

Development Inhibitor-Releasing Compound

Compounds represented by formula (I), (II), (III) or (IV) described at page 11 of EP-A-378236 (particularly, T-101 (page 30), T-104 (page 31), T-113 (page 36), T-131 (page 45), T-144 (page 51) and T-158 (page 58)); compounds represented by formula (I) described at page 7 of EP-A-436938 (particularly, D-45 (page 51)); compounds represented by formula (1) of EP-A-568037 (particularly, Compound (23) at page 11); and compounds represented by formula (I), (II) or (III) described at pages 5 and 6 of EP-A-440195 (particularly, Compound I-(1) at page 29);

Bleaching Accelerator-Releasing Compound

Compounds represented by formula (I) or (I') at page 5 of EP-A-310125 (particularly Compounds (60) and (61) at page 61); and compounds represented by formula (I) in claim 1 of JP-A-6-59411 (particularly, Compound (7) at page 7);

Ligand-Releasing Compound

Compounds represented by LIG-X described in claim 1 of U.S. Pat. No. 4,555,478 (particularly, compounds in column 12, lines 21 to 41);

Leuco Dye-Releasing Compound

Compounds 1 to 6 in columns 3 to 8 of U.S. Pat. No. 4,749,641;

Fluorescent Dye-Releasing Compound

Compounds represented by COUP-DYE in claim 1 of U.S. Pat. No. 4,774,181 (particularly, Compounds 1 to 11 in columns 7 to 10);

Development Accelerator- or Fogging Agent-Releasing Compound

Compounds represented by formula (1), (2) or (3) in column 3 of U.S. Pat. No. 4,656,123 (particularly Compound (I-22) in column 25) and Compound ExZK-2 at page 75, lines 36 to 38 of EP-A-450637;

Compound Which Releases A Group Capable of Becoming Dye First When Released

Compounds represented by formula (I) in claim 1 of U.S. Pat. No. 4,857,447 (particularly, Compounds Y-1 to Y-19 in columns 25 to 36).

Preferred additives other than couplers are described below.

Dispersion Medium of Oil-Soluble Organic Compound

Compounds P-3, P-5, P-16, P-19, P-25, P-30, P-42, P-49, P-54, P-55, P-66, P-81, P-85, P-86 and P-93 of JP-A-62-215272 (pages 140 to 144);

Latex for Impregnation of Oil-Soluble Organic Compound

Latexes described in U.S. Pat. No. 4,199,363;

Developing Agent Oxidation Product Scavenger

Compounds represented by formula (I) in column 2, lines 54 to 62 of U.S. Pat. No. 4,978,606 (particularly, Compounds I-(1), I-(2), I-(6) and I-(12) (columns 4 to 5)) and compounds represented by any one of the formulae in column 2, lines 5 to 10 of U.S. Pat. No. 4,923,787 (particularly, Compound 1 (column 3));

Stain Inhibitor

Compounds represented by formula (I), (II) or (III) at page 4, lines 30 to 33 of EP-A-298321 (particularly, Compounds I-47, I-72, III-1 and III-27 (pages 24 to 48));

Discoloration Inhibitor

Compounds A-6, A-7, A-20, A-21, A-23, A-24, A-25, A-26, A-30, A-37, A-40, A-42, A-48, A-63, A-90, A-92, A-94 and A-164 of EP-A-298321 (pages 69 to 118), Compounds II-1 to III-23 in columns 25 to 38 of U.S. Pat. No. 5,122,444 (particularly, Compound III-10), Compounds I-1 to III-4 at pages 8 to 12 of EP-A-471347 (particularly, Compound II-2) and Compounds A-1 to A-48 in columns 32 to 40 of U.S. Pat. No. 5,139,931 (particularly, Compounds A-39 and A-42);

Material Which Reduces Use Amount of Coloration Reinforcing Agent or Color Mixing Inhibitor Compounds I-1 to II-15 at pages 5 to 24 of EP-A-411324 (particularly, Compound I-46);

Formalin Scavenqer

Compounds SCV-1 to SCV-28 at pages 24 to 29 of EP-A-477932 (particularly Compound SCV-8);

Hardening Agent

Compounds H-1, H-4, H-6, H-8 and H-14 at page 17 of JP-A-1-214845, compounds (Compounds H-1 to H-54) represented by any one of formulae (VII) to (XII) in columns 13 to 23 of U.S. Pat. No. 4,618,573, compounds (Compounds H-1 to H-76) represented by formula (6) at page 8, right lower column of JP-A-2-214852 (particularly, Compound H-14) and compounds described in claim 1 of U.S. Pat. No. 3,325,287;

Development Inhibitor Precursor

Compounds P-24, P-37 and P-39 of JP-A-62-168139 (pages 6 and 7) and compounds described in claim 1 of U.S. Pat. No. 5,019,492 (particularly, Compounds 28 and 29 in column 7);

Antiseptic, Antifungal

Compounds I-1 to III-43 in columns 3 to 15 of U.S. Pat. No. 4,923,790 (particularly, Compounds II-1, II-9, II-10, II-18 and III-25);

Stabilizer, Antifoggant

Compounds I-1 to (14) in columns 6 to 16 of U.S. Pat. No. 4,923,793 (particularly, Compounds I-1, I-60, (2) and (13)) and Compounds 1 to 65 in columns 25 to 32 of U.S. Pat. No. 4,952,483 (particularly, Compound 36);

Chemical Sensitizer

Triphenylphosphine, selenide and Compound 50 of JP-A-5-40324;

Dye

Compounds a-1 to b-20 at pages 15 to 18 (particularly, Compounds a-1, a-12, a-18, a-27, a-35, a-36 and b-5) and Compounds V-1 to V-23 at pages 27 to 29 of JP-A-3-156450 (particularly, Compound V-1), Compounds F-I-1 to F-II-43 at pages 33 to 55 of EP-A-445627 (particularly, Compounds F-I-11 and F-II-8), Compounds III-1 to III-36 at pages 17 to 28 of EP-A-457153 (particularly, Compounds III-1 and III-3), fine crystal dispersion products of Dye-1 to Dye-124 at pages 8 to 26 of WO88/04794, Compounds 1 to 22 at pages 6 to 11 of EP-A-319999 (particularly, Compound 1), Compounds D-1 to D-87 (pages 3 to 28) represented by formula (1), (2) or (3) of EP-A-519306, Compounds 1 to 22 (columns 3 to 10) represented by formula (I) of U.S. Pat. No. 4,268,622 and Compounds (1) to (31) (columns 2 to 9) represented by formula (I) of U.S. Pat. No. 4,923,788;

UV Absorbent

Compounds (18b) to (18r) and Compounds 101 to 427 (pages 6 to 9) represented by formula (1) of JP-A-46-3335, Compounds (3) to (66) (pages 10 to 44) represented by formula (I) and Compounds HBT-1 to HBT-10(page 14) represented by formula (III), of EP-A-520938, and Compounds (1) to (31) (columns 2 to 9) represented by formula (1) of EP-A-521823.

Examples of appropriate supports which can be used in the present invention are described in RD No. 17643, page 28, ibid., No. 18716, from page 647, right column to page 648, left column and ibid., No. 307105, page 879.

In the light-sensitive material of the present invention, the total thickness of all hydrophilic colloid layers on the side having emulsion layers is preferably 28 μm or less, more preferably 23 μm or less, still more preferably 18 μm or less and particularly preferably 16 μm or less. The layer swelling speed $T_{1/2}$ is preferably 30 seconds or less, more preferably 20 seconds or less. $T_{1/2}$ is defined as the time required for the layer thickness to reach a half (½) of a saturation layer thickness which corresponds to 90% of the maximum swollen thickness achieved on processing with a color developer at 30° C. for 3 minutes and 15 seconds. The layer thickness means a layer thickness determined at 25° C. and a relative humidity of 55% under humidity conditioning (2 days). $T_{1/2}$ can be measured by means of a swellometer described in A. Green et. al., *Photoqr. Sci. Eng.*, Vol. 19, 2, pp. 124–129. The $T_{1/2}$ can be controlled by adding a hardening agent to gelatin as a binder or changing the aging conditions after the coating. The swelling rate is preferably from 150 to 400%. The swelling rate can be obtained from the maximum swollen layer thickness under the above-described conditions according to the formula: (maximum swollen layer thickness—layer thickness)/layer thickness.

In the light-sensitive material of the present invention, a hydrophilic colloid layer (called back layer) having a total dry thickness of from 2 to 20 μm is preferably provided on the side opposite to the side having emulsion layers. This back layer preferably contains a light absorbent, a filter dye, an ultraviolet absorbent, an antistatic agent, a hardening agent, a binder, a plasticizer, a lubricant, a coating agent or a surface active agent which all are described above. The back layer has a swelling rate of preferably from 150 to 500%.

The light-sensitive material of the present invention can be developed according to usual methods described in RD No. 17643, pp. 28–29, ibid., No. 18716, p. 651, from left to right columns and ibid., No. 307105, pp. 880–881.

The color developer for use in the development of the light-sensitive material of the present invention is preferably an alkaline aqueous solution comprising as a main component an aromatic primary amine color developing agent. As the color developing agent, an aminophenol-base compound is useful but a p-phenylenediamine-base compound is preferably used and representative and preferred examples thereof include compounds described in EP-A-556700, page 28, lines 43 to 52. These compounds may be used in combination of two or more depending on the purpose.

The color developer usually contains a pH buffering agent such as a carbonate, a borate or a phosphate of an alkali metal or a development inhibitor or an antifoggant such as a chloride salt, a bromide salt, an iodide salt, a benzimidazole, a benzothiazole and a mercapto compound. The color developer may also contain, if desired, a preservative such as hydroxylamine, diethylhydroxylamine, sulfite, hydrazines (e.g., N, N-biscarboxymethylhydrazine), phenylsemicarbazides, triethanolamine and catecholsulfonic acids; an organic solvent such as ethylene glycol and diethylene glycol; a development accelerator such as benzyl alcohol, polyethylene glycol, quaternary ammonium salts and amines; a dye-forming coupler; a competing coupler; an auxiliary developing agent such as 1-phenyl-3-pyrazolidone; a tackifying agent; and various chelating agents including aminopolycarboxylic acid, aminopolyphosphonic acid, alkylphosphonic acid and phosphonocarboxylic acid, such as ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1, 1-diphosphonic acid, nitrilo-N,N,N-trimethylenephosphonic acid, ethylenediamine-N,N,N,N-tetramethylenephosphonic acid, ethylenediamine-di (o-hydroxyphenylacetic acid) and a salt thereof.

In carrying out reversal processing, the color development usually follows black-and-white development. The black-and-white developer uses known black-and-white developing agents such as dihydoxybenzenes (e.g., hydroquinone), 3-pyrazolidones (e.g., 1-phenyl-3-pyrazolidone) and aminophenols (e.g., N-methyl-p-aminophenol) individually or in combination. The color developer or the black-and-white developer usually has a pH of from 9 to 12. The replenishing amount of these developers is, although it may vary depending on the color photographic light-sensitive material processed, generally 3 ℓ or less per $m^2$ of the light-sensitive material and when the bromide ion concentration in the replenisher is lowered, the replenishing amount may be reduced to 500 ml or less. When the replenishing amount is reduced, the contact area of the processing tank with air is preferably reduced to prevent evaporation or air oxidation of the solution.

The processing effect resulting from contact of the photographic processing solution with air in a processing tank can be evaluated by the opening ratio (=[contact area of the processing solution with air ($cm^2$)]÷[volume of the processing solution ($cm^3$)]. The opening ratio as defined above is preferably 0.1 or less, more preferably from 0.001 to 0.05.

The opening ratio can be reduced, for example, by providing a shielding material such as a floating lid on the surface of the photographic processing solution in the processing tank, by using a movable lid described in JP-A-1-82033 or by a slit development method described in JP-A-63-216050. The opening ratio is preferably reduced not only in the color development and black-and-white development but also in all subsequent steps such as bleaching, bleach-fixing, fixing, water washing and stabilization. Further, by using a means for suppressing accumulation of the bromide ions in the developer, the replenishing amount can be reduced.

The color development time is usually set to from 2 to 5 minutes, however, further reduction in the processing time can be achieved by performing the processing at a high temperature and a high pH and at the same time, by using a color developing agent in a high concentration.

After the color development, the photographic emulsion layer is usually subjected to bleaching. The bleaching may be performed at the same time with fixing (bleach-fixing) or may be performed separately. For the purpose of achieving rapid processing, the bleaching may be followed by bleach-fixing. Further, a processing in a bleach-fixing bath consisting of two continuous tanks, a processing comprising fixing before bleach-fixing or a processing comprising bleaching after bleach-fixing may be freely selected depending on the purpose. Examples of the bleaching agent include compounds of a polyvalent metal such as iron(III), peracids, quinones and nitro compounds. Representative examples of the bleaching agent include organic complex salts of iron (III), such as complex salts with an aminopolycarboxylic acid (e.g., ethylenediaminetetraacetic acid, diethylenetriaminepentaacetic acid, cyclohexane- diaminetetraacetic acid, methylaminodiacetic acid, 1, 3-diaminopropanetetraacetic acid, glycol ether diaminetetraacetic acid) and complex salts with a citric acid, a tartaric acid or a malic acid. Among these, an aminopolycarboxylic acid ferrate complex salt including ethylenediaminetetraacetato ferrate complex salt and 1,3-diaminopropanetetraacetato ferrate complex salt is preferred in view of rapid processing and prevention of environmental pollution. Further, the aminopolycarboxylic acid ferrate complex salt is particularly useful for the bleaching solution or for bleach-fixing solution. The bleaching solution or the bleach-fixing solution using the aminopolycarboxylic acid ferrate complex salt has a pH of generally from 4.0 to 8 but the processing may be performed at a lower pH for expediting the processing.

The bleaching solution, the bleach-fixing solution or a prebath thereof may use a bleaching accelerator, if desired. Specific examples of useful bleaching accelerators include compounds having a mercapto group or a disulfide group described in U.S. Pat. No. 3,893,858, German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and RD No. 17129 (July, 1978); thiazolidine derivatives described in JP- 50 -140129 ; thiourea derivatives described in JP-B-45-8506, JP-A-52-20832, JP-A-53-32735 and U.S. Pat. No. 3,706,561; iodide salts described in German Patent 1,127,715 and JP-A-58-16235; polyoxyethylene compounds described in German Patent Nos. 966,410 and 2,748,430; polyamine compounds described in JP-B-45-8836; compounds described in JP-A-49-40943, JP-A-49-59644, JP-A-53-94927, JP-A-54-35727, JP-A-55-26506 and JP-A-58-163940; and bromide ions. Among these, compounds having a mercapto group or a disulfide group are preferred in view of their large acceleration effect and in particular, compounds described in U.S. Pat. No. 3,893,858, German Patent No. 1,290,812 and JP-A-53-95630 are preferred. Also, compounds described in U.S. Pat. No. 4,552,834 are preferred. The bleaching accelerator may be incorporated into the light-sensitive material. The bleaching accelerator is particularly effective in bleach-fixing a color light-sensitive material for photographing.

In addition to the above-described compounds, the bleaching solution or the bleach-fixing solution preferably contains an organic acid in order to prevent bleaching stain. A particularly preferred organic acid is a compound having an acid dissociation constant (pKa) of from 2 to 5 and specific examples thereof include acetic acid, propionic acid and hydroxyacetic acid.

Examples of the fixing agent for use in the fixing solution or the bleach-fixing solution include thiosulfates, thiocyanates, thioether-base compounds, thioureas and a large quantity of iodides. Among these, a thiosulfate is commonly used and an ammonium thiosulfate can be most widely used. Also, a combination use of a thiosulfate with a thiocyanate, a thioether-base compound or a thiourea is preferred. As the preservative for the fixing solution or the bleach-fixing solution, sulfites, bisulfites, carbonyl bisulfite adducts and sulfinic acid compounds described in EP-A-294769 are preferred. Further, the fixing solution or the bleach-fixing solution preferably contains an aminopolycarboxylic acid or an organic phosphonic acid for the purpose of stabilization of the solution.

In the present invention, in order to adjust the pH, the fixing solution or the bleach-fixing solution preferably contains a compound having a pKa of from 6.0 to 9.0, preferably an imidazole such as imidazole, 1-methylimidazole, 1-ethylimidazole and 2-methylimidazole, in an amount of from 0.1 to 10 mol/liter.

The total desilvering time is preferably as short as possible if desilvering failure is not caused. The time is preferably from 1 to 3 minutes, more preferably from 1 to 2 minutes. The processing temperature is from 25° to 50° C., preferably from 35° to 45° C. In this preferred temperature range, the desilvering rate is improved and occurrence of stains after the processing can be effectively prevented.

In the desilverization, the stirring is preferably intensified as highly as possible. Specific examples of the method for intensifying stirring include a method of colliding a jet stream of a processing solution against the emulsion surface of the light-sensitive material described in JP-A-62-183460, a method of increasing the stirring effect using a rotary means described in JP-A-62-183461, a method of increasing the stirring effect by moving the light-sensitive material while putting the emulsion surface into contact with a wiper blade provided in the solution to cause turbulence on the emulsion surface, and a method of increasing the circulation flow rate of the entire processing solutions. Such a means for intensifying the stirring is effective in any of the bleaching solution, the bleach-fixing solution and the fixing solution. The intensification of stirring is considered to increase the supply rate of the bleaching agent or the fixing agent into the emulsion layer and as a result, to elevate the desilverization rate. The above-described means for intensifying stirring is more effective when a bleaching accelerator is used and in this case, the acceleration effect can be outstandingly increased or the fixing inhibitory action by the bleaching accelerator can be eliminated.

The automatic developing machine used for the light-sensitive material of the present invention preferably has a transportation means of a light-sensitive material described in JP-A-60-191257, JP-A-60-191258 and JP-A-60-191259.

As described in JP-A-60-191257 above, this transportation means can extremely decrease the amount of a processing solution carried over from a previous bath to a post bath, provides a great effect in preventing deterioration in capability of the processing solution and is particularly effective in reducing the processing time or decreasing the replenishing amount of a processing solution, at each step.

The light-sensitive material of the present invention is generally subjected to water washing and/or stabilization after desilvering. The amount of water in the water washing step can be set over a wide range according to the characteristics (e.g., due to the material used such as a coupler) or use of the light-sensitive material and in addition, the temperature of washing water, the number of water washing tanks (stage number), the replenishing system such as countercurrent and co-current or other various conditions. Among these, the relation between the number of water washing tanks and the amount of water in a multi-stage countercurrent system can be obtained according to the method described in *Journal of the Society of Motion Picture and Television Engineers*, Vol. 64, pp. 248–253 (May, 1955). According to the multi-stage countercurrent system described in the above-described publication, the amount of washing water may be greatly reduced but due to the increase in the residence time of water in the tank, a problem is caused such that bacteria proliferate and the floats generated adhere to the light-sensitive material. In order to solve such a problem, a method of reducing calcium ions or magnesium ions described in JP-A-62-288838 can be very effectively used. Further, an isothiazolone compound or a thiabendazole described in JP-A-57-8542, a chlorine-based bactericide such as sodium chlorinated isocyanurate, or a bactericide such as benzotriazoles and those described in Hiroshi Horiguchi, *Bokin, Bobai-Zai no Kagaku (Chemistry of Bactericide and Antifunoal)*, Sankyo Shuppan (1986), *Biseibutsu no Mekkin, Sakkin, Bobai-Giiutsu (Germicidal, Bactericidal and Antifungal Technology of Microorganism)* compiled by Eisei Gijutsu Kai, issued by Kogyo Gijutsu Kai (1982), and *Bokin-Bobai Zai Jiten (Lexicon of Bactericide and Antifungal)* compiled by Nippon Bokin Bobai Gakkai (1986) may be also used.

The washing water in the processing of the light-sensitive material of the present invention has a pH of from 4 to 9, preferably from 5 to 8. The processing temperature and the processing time at the water washing may be set variously according to the characteristics and use of the light-sensitive material, but they are commonly from 15° to 45° C. and from 20 seconds to 10 minutes, preferably from 25° to 40° C. and from 30 seconds to 5 minutes, respectively. The light-sensitive material of the present invention may also be processed directly with a stabilizing solution in place of the above-described water washing. In such a stabilization processing, any known method described in JP-A-57-8543, JP-A-58-14834 and JP-A-60-220345 may be used.

In some cases, the stabilization processing may be further performed after the above-described water washing. An example thereof is a stabilization bath containing a dye stabilizing agent and a surface active agent, used as a final bath of a color light-sensitive material for photographing. Examples of the dye stabilizing agent include aldehydes such as formalin and glutaraldehyde, N-methylol compounds and hexamethylenetetramine or aldehyde sulfite addition products.

This stabilization bath may also contain various chelating agents and antifungals.

The overflow solution accompanying the replenishing of the above-described washing water and/or stabilizing solution can be re-used in other processing steps such as desilvering.

In the processing, for example, using an automatic developing machine, if the above-described respective processing solutions are concentrated due to evaporation, water is preferably added to correct the concentration.

A color developing agent may be incorporated into the light-sensitive material of the present invention so as to simplify and expedite the processing. The color developing agent is preferably incorporated into the light-sensitive material in the form of a precursor. Examples of the precursor include indoaniline-base compounds described in U.S. Pat. 3,342,597, Schiff base-type compounds described in U.S. Pat. 3,342,599, RD No. 14850 and ibid., No. 15159, aldol compounds described in ibid., No. 13924, metal salt complexes described in U.S. Pat. No. 3,719,492 and urethane-base compounds described in JP-A-53-135628.

The light-sensitive material of the present invention may contain, if desired, various 1-phenyl-3-pyrazolidones for the purpose of accelerating the color development. Typical examples of the compound are described in JP-A-56-64339, JP-A-57-144547 and JP-A-58-115438.

Each processing solution used for processing the light-sensitive material of the present invention is used at a temperature of from 10 to 50° C. Usually, the temperature as a standard is from 33° to 38° C. but higher temperatures may be used to accelerate the processing to thereby reduce the processing time or on the contrary, lower temperatures may be used to achieve improved image quality or improved stability of the processing solution.

There is no particular restriction on various additives and the development processing method used when the present invention is applied to a black-and-white light-sensitive material and, for example, those described in JP-A-2-68539, JP-A-5-11389 and JP-A-2-58041 can be preferably used, of which pertinent portions are described below.

1. Silver halide emulsion and production process thereof:
   JP-A-2-68539, from page 8, right lower column, line 6 from the bottom to page 10, right upper column, line 12
2. Chemical sensitization method:
   JP-A-2-68539, page 10, from right upper column, line 13 to left lower column, line 16, and selenium sensitization method described in JP-A-5-11389
3. Antifoggant, stabilizer:
   JP-A-2-68539, from page 10, left lower column, line 17 to page 11, left upper column, line 7 and from page 3, left lower column, line 2 to page 4, left lower column
4. Spectral sensitizing dye:
   JP-A-2-68539, from page 4, right lower column, line 4 to page 8, right lower column and JP-A-2-58041, page 12, from left lower column, line 8 to right lower column, line 19
5. Surface active agent, antistatic agent:
   JP-A-2-68539, from page 11, left upper column, line 14 to page 12, left upper column, line 9 and JP-A-2-58041, from page 2, left lower column, line 14 to page 5, line 12
6. Matting agent, plasticizer, lubricant:
   JP-A-2-68539, page 12, from left upper column, line 10 to right upper column, line 10 and JP-A-2-58041, from page 5, left lower column, line 13 to page 10, left lower column, line 3
7. Hydrophilic colloid:
   JP-A-2-68539, page 12, from right upper column, line 11 to left lower column, line 16

8. Hardening agent:
   JP-A-2-68539, from page 12, left lower column, line 17 to page 13, right upper column, line 6
9. Development processing method:
   JP-A-2-68539, page 15, from left upper column, line 14 to left lower column, line 13

In addition, the present invention can be applied to a diffusion transfer photograph, a so-called instant photograph. Examples of the diffusion transfer photograph are described in JP-A-5-297544.

The present invention can also be applied to a heat developable light-sensitive material. The heat developable light-sensitive material to which the present invention can be applied may be one forming a black-and-white image or one forming a color image, and examples thereof include heat developable light-sensitive materials described in JP-A-60-162251, JP-A-64-13546, JP-A-1-161236, U.S. Pat. Nos. 4,474,867, 4,478,927, 4,507,380, 4,500,626, 4,483,914, 4,783,396 and 4,740,445, JP-A-59-231539 and JP-A-60-2950.

The present invention may also be used for a wet reversal color copying material using an autopositive emulsion. This material is described as Sample No. 101 in Example 1 of JP-A-3-152530 or as Sample No. 1 in JP-A-2-90145.

The silver halide light-sensitive material for color diffusion transfer to which the present invention can be applied, is described below.

The light-sensitive material for use in the present invention fundamentally comprises a support having thereon a light-sensitive silver halide, a binder and a dye donative compound (which may serve as a reducing agent at the same time). These components are in many cases added to the same layer but if they are in the state capable of reaction, these compounds may be separately added to separate layers. For example, when a colored dye-donative compound is present in a lower layer of a silver halide emulsion, reduction in sensitivity can be prevented.

In order to obtain colors over a wide range within the chromaticity diagram using three primary colors of yellow, magenta and cyan, at least three silver halide emulsion layers having light sensitivity in different spectral regions are used in combination. For example, a three-layer combination of a blue-sensitive layer, a green-sensitive layer and a red-sensitive layer, a combination of a green-sensitive layer, a red-sensitive layer and an infrared-sensitive layer, and a combination of a red-sensitive layer, a first infrared-sensitive layer and a second infrared-sensitive layer may be used. Respective light-sensitive layers may be arranged in various orders known to the normal color light-sensitive layer. Each light-sensitive layer may be divided into two or more layers, if desired.

The heat-developable color light-sensitive material may comprise various auxiliary layers such as a protective layer, an undercoat layer, an interlayer, a yellow filter layer, an antihalation layer and a back layer. (Fundamental Construction and Preparation Method of Silver Halide Grain)

The silver halide which can be used in the present invention may be any of silver chloride, silver bromide, silver iodobromide, silver chlorobromide, silver iodochloride and silver chloroiodobromide, however, silver iodobromide, silver chloride, silver bromide or silver chlorobromide having a silver iodide content of 30 mol% or less is preferred.

The silver halide emulsion for use in the present invention may be either a superficial latent image-type emulsion or an internal latent image-type emulsion. The internal latent image-type emulsion in combination with a nucleating agent or with light fogging is used as a direct reversal emulsion. A so-called multiple structure grain having different halogen compositions between the grain inside and the grain surface may also be used. Among the multiple structure grains, particularly those having a double structure is sometimes called a core/shell grain.

The silver halide for use in the present invention is preferably a multiple structure grain, more preferably a core/shell grain, however, the present invention is by no means limited thereto.

The silver halide emulsion for use in the present invention is preferably a monodisperse emulsion having a coefficient of variation defined in JP-A-3-110555 of preferably 20% or less, more preferably 16% or less, still more preferably 10% or less, however, the present invention is by no means limited to these monodisperse emulsions.

The grain size of silver halide grains for use in the present invention is from 0.1 to 2.2 $\mu$m, preferably from 0.1 to 1.2 $\mu$m. With respect to the crystal habit of silver halide grain, any of a cubic grain, an octahedral grain, a tabular grain having a high aspect ratio, a pebble-like grain and other grains may be used. A cubic emulsion is more preferred.

More specifically, silver halide emulsions described in U.S. Pat. Nos. 4,500,626 (column 50) and 4,628,021, RD No. 17029 (1978) and JP-A-62-25159 all may be used.

The silver halide emulsion for use in the present invention may contain a heavy metal such as Ir, Rh, Pt, Cd, Zn, Th, Pb, Fe or Cr, for various purposes. These compounds may be used individually or in combination of two or more of them. The addition amount varies depending on the purpose, however, in general, it is approximately from $10^{-9}$ to $10^{-3}$ mol per mol of silver halide. The compound may be incorporated uniformly into a grain or may be localized in the inside or on the surface of a grain.

The addition amount of Ir for use in the present invention is preferably from $10^{-9}$ to $10^{-4}$ mol, more preferably from $10^{-8}$ to $10^{-6}$ mol, per mol of silver halide. In the case of a core/shell grain, Ir may be added to the core and/or the shell. Preferred examples of the Ir compound include $K_2IrCl_6$ and $K_3IrCl_6$.

The addition amount of rhodium for use in the present invention is preferably from $10^{-9}$ to $10^{-6}$ mol per mol of silver halide.

The addition amount of iron for use in the present invention is preferably from $10^{-7}$ to $10^{-3}$, more preferably from $10^{-6}$ to $10^{-3}$ mol, per mol of silver halide.

A method where a part or the whole of the above-described heavy metal is previously doped to a fine grain emulsion of silver chloride, silver chlorobromide, silver bromide or silver iodobromide and the fine grain emulsion is added to locally dope the metal onto the surface of the silver halide grain, is also preferably used.

When the present invention is applied to a heat developable light-sensitive material, an organic metal salt may be used as an oxidizing agent in combination with the light-sensitive silver halide. Among the organic metal salts, an organic silver salt is particularly preferably used.

Examples of the organic compound which can be used for forming the above-described organic silver salt oxidizing agent, include benzotriazoles described in U.S. Pat. 4,500,626, columns 52 and 53, fatty acids and other compounds. Further, silver salts of a carboxylic acid having an alkynyl group, such as silver phenylpropiolate, described in JP-A-60-113235 and silver acetylide described in JP-A-61-249044 are also useful. The organic silver salts may be used in combination of two or more thereof.

The organic silver salt is used in an amount of from 0.01 to 10 mol, preferably from 0.01 to 1 mol, per mol of light-sensitive silver halide. The coating amount in total of the light-sensitive silver halide and the organic silver salt is suitably from 50 mg/m$^2$ to 10 g/m$^2$ as calculated in terms of silver.

In the present invention, various antifoggants and photographic stabilizers may be used. Examples thereof include azoles and azaindenes described in RD, No. 17643, pp. 24–25 (1978), nitrogen-containing carboxylic acids and phosphoric acids described in JP-A-59-168442, mercapto compounds and metal salts thereof described in JP-A-59-111636, and acetylene compounds described in JP-A-62-87957.

When a system of performing heat development while supplying a slight amount of water is used, water can be absorbed rapidly by using a highly water-absorbing polymer. Further, when a highly water-absorbing polymer is used in a dye-fixing layer or a protective layer thereof, re-transfer of the transferred dye from the dye-fixing element to other members can be prevented.

In the present invention, the coating amount of the binder is preferably 20 g/m$^2$ or less, more preferably 10 g/m$^2$ or less, and still more preferably 7 g/m$^2$ or less.

The reducing agent for use in the present invention may be one known in the field of light-sensitive materials. The reducing agent also includes a dye-donative compound having a reducing property, which will be described later (in this case, other reducing agent can be used in combination). Further, a reducing agent precursor which itself has no reducing property but shows the reducing property due to action of a nucleophilic reagent or heat during the development, may also be used.

Examples of the reducing agent for use in the present invention include reducing agents and reducing agent precursors described in U.S. Pat. Nos. 4,500,626 (columns 49 and. 50), 4,483,914 (columns 30 and 31), 4,330,617 and 4,590,152, JP-A-60-140335 (pages (17) and (18)), JP-A-57-40245, JP-A-56-138736, JP-A-59-178458, JP-A-59-53831, JP-A-59-182449, JP-A-59-182450, JP-A-60-119555, JP-A-60-128436 through JP-A-60-128439, JP-A-60-198540, JP-A-60-181742, JP-A-61-259253, JP-A-62-244044, JP-A-62-131253 through JP-A-62-131256, and EP-A-220746 (pages 78 to 96).

A combination of various reducing agents as disclosed in U.S. Pat. No. 3,039,869 can also be used.

When a non-diffusible reducing agent is used, an electron transfer agent and/or an electron transfer agent precursor may be used in combination, if desired, so as to accelerate the movement of electrons between the non-diffusible reducing agent and the developable silver halide.

The electron transfer agent or a precursor thereof may be selected from the above-described reducing agents and precursors thereof. The electron transfer agent or the precursor thereof preferably has mobility larger than that of the non-diffusible reducing agent (electron donor). Particularly useful electron transfer agents are 1-phenyl-3-pyrazolidones and aminophenols.

The non-diffusible reducing agent (electron donor) for use in combination with the electron transfer agent may be selected from the above-described reducing agents as long as it does not substantially move between layers of the light-sensitive material. Preferred examples thereof include hydroquinones, sulfonamidophenols, sulfonamidonaphthols, compounds described as the electron donor in JP-A-53-110827, and non-diffusible dye-donative compounds having a reducing property which will be described later.

In the present invention, the addition amount of the reducing agent is from 0.01 to 20 mol, preferably from 0.1 to 10 mol, per mol of silver.

In the present invention, the photographic light-sensitive material contains a compound which forms or releases a mobile dye in correspondence or counter-correspondence to the reaction of reducing silver ions to silver under high temperature conditions, namely, a dye-donative compound.

The dye-donative compound which can be used in the present invention includes the compound represented by the following formula (LI):

$$(\text{Dye-G})_q\text{—y} \qquad (LI)$$

wherein Dye represents a dye group, a dye group the absorption wavelength peak of which is temporarily shifted to the shorter wavelength side or a dye precursor group, G represents a mere bond or a linking group, Y represents a group capable of, in correspondence or counter-correspondence to the light-sensitive silver salt having imagewise a latent image, causing difference in diffusibility among the compounds represented by $(\text{Dye-G})_q$—Y or releasing Dye to cause difference in diffusibility between Dye and $(\text{Dye-G})_q$—Y, q represents 1 or 2, and when q is 2, two Dye-G groups may be the same or different.

In the case of a substantially water-insoluble compound, a method of forming the compound into fine particles and then dispersing and incorporating them into the binder may be used.

In dispersing a hydrophobic compound in a hydrophilic colloid, various surface active agents may be used. Examples thereof include those described as the surface active agent in JP-A-59-157636, pages (37) and (38).

In the present invention, the light-sensitive material may use a compound capable of achieving activation of development and at the same time, stabilization of the image. Preferred specific examples thereof include those described in U.S. Pat. No. 4,500,626, columns 51 and 52.

In the present invention, the photographic light-sensitive material may contain a non-diffusible filter dye for the purpose of improving sharpness or the like. If desired, a filter dye having absorption in the infrared region may also be used. These filter dyes are described in detail in JP-A-2-137885, JP-A-4-217243, JP-A-4-276744 and JP-A-5-45834.

In a system of forming an image by diffusion transfer of a dye, a dye-fixing element is used in combination with the light-sensitive material. The dye-fixing element and the light-sensitive material may be independently provided on separate supports or may be provided on the same support. With respect to the interrelation between the light-sensitive material and the dye-fixing element or with respect to the relationship with the support and the relationship with the white reflecting layer, the relationship described in U.S. Pat. 4,500,626, column 57, can be applied also to the present invention.

The dye-fixing element which is preferably used in the present invention has at least one layer containing a mordant and a binder. The mordant may be one known in the photographic field. Specific examples thereof include mordants described in U.S. Pat. No. 4,500,626 (columns 58 and 59) and JP-A-61-88256 (pages (32) to (41)), and those described in JP-A-62-244043 and JP-A-62-244036. Further, dye-acceptive polymer compounds described in U.S. Pat. No. 4,463,079 may also be used.

In the dye-fixing element, if desired, auxiliary layers such as a protective layer, a peeling-off layer or a curling-preventive layer may be provided. It is particularly advantageous to provide a protective layer.

The constituent layers of the light-sensitive material or the dye-fixing element may contain a plasticizer, a slipping agent, or a high boiling point organic solvent as an improver of releasability between the light-sensitive material and the dye-fixing element. Specific examples thereof include those described in JP-A-62-253159 (page (25)) and JP-A-62-245253. Further, in order to achieve the above-described purpose, various silicone oils (including all silicone oils of from dimethyl silicone oil to modified silicone oils resulting from introducing various organic groups into dimethylsiloxane) may be used. Examples thereof include various modified silicone oils described in *Modified Silicone Oils (Technical Data P*6-18B), issued by Shin-Etsu Silicone KK. In particular, a carboxy-modified silicone (trade name: X-22-3710) is effective. Further, silicone oils described in JP-A-62-215953 and JP-A-63-46449 are also effective.

The light-sensitive material and the dye-fixing element may use a discoloration inhibitor. Examples of the discoloration inhibitor include an antioxidant, an ultraviolet absorbent and a certain kind of metal complexes.

Examples of the antioxidant include chroman-base compounds, coumarane-base compounds, phenol-base compounds (e.g., hindered phenols), hydroquinone derivatives, hindered amine derivatives and spiroindane-base compounds. Also, the compounds. described in JP-A-61-159644 are effective.

Examples of the ultraviolet absorbent include benzotriazole-base compounds (described, for example, in U.S. Pat. 3,533,794), 4-thiazolidone-base compounds (described, for example, in U.S. Pat. No. 3,352,681), benzophenone-base compounds (described, for example, in JP-A-46-2784) and compounds described in JP-A-54-48535, JP-A-62-136641 and JP-A-61-88256. Also, ultraviolet absorptive polymers described in JP-A-62-260152 are effective.

Examples of the metal complex include compounds described in U.S. Pat. Nos. 4,241,155, 4,245,018 (columns 3 to 36) and 4,254,195 (columns 3 to 8), JP-A-62-174741, JP-A-61-88256 (pages (27) to (29)), JP-A-63-199248, JP-A-1-75568 and JP-A-1-74272.

Examples of useful discoloration inhibitors are described in JP-A-62-215272 (pages (125) to (137)).

The discoloration inhibitor which inhibits discoloration of a dye transferred onto the dye-fixing element, may be previously incorporated into the dye-fixing element or may be supplied to the dye-fixing element from the external, for example, from the light-sensitive material.

The above-described antioxidant, ultraviolet absorbent and metal complex may be used in combination with each other.

The light-sensitive material or the dye-fixing element may use a brightening agent. It is particularly preferred to incorporate the brightening agent into the dye-fixing element or to supply it from the external, for example, from the light-sensitive material. Examples of the brightening agent include the compounds described in K. Veenkataraman (compiler), *The Chemistry of Synthetic Dyes,* Vol. V, Chap. 8, and JP-A-61-143752.

Examples of various additives for use in the constituent layers of the light-sensitive material or the dye-fixing element include those described above for use in the silver halide color photographic light-sensitive material.

In addition, the constituent layers of the light-sensitive material or the dye-fixing element may contain a heat solvent, a defoaming agent, a bactericide/antifungal or colloidal silica. Specific examples of these additives are described in JP-A-61-88256 (pages (26) to (32)).

In the present invention, the light-sensitive material and/or the dye-fixing element may use an image formation accelerator. The image formation accelerator has a function of accelerating the redox reaction of a silver salt oxidizing agent with a reducing agent, accelerating the reaction such as production of a dye from a dye-donative substance, decomposition of the dye or release of a diffusible dye, and accelerating the movement of a dye from the light-sensitive material layer to the dye-fixing layer. In view of physicochemical function, the accelerator is classified into bases or base precursors, nucleophilic compounds, high boiling point organic solvents (oil), heat solvents, surface active agents and compounds having interaction with silver or silver ion. However, these substances each usually has a composite function and usually shows several acceleration effects at the same time. These substances are described in detail in U.S. Pat. No. 4,678,739 (columns 38 to 40).

The base precursor includes salts of an organic acid which is decarboxylated on heating, with a base, and compounds which release amines by intramolecular nucleophilic substitution reaction, Lossen rearrangement or Beckmann rearrangement. Specific examples thereof are described in U.S. Pat. 4,511,493 and JP-A-62-65038.

In a system where heat development and transfer of a dye are performed simultaneously in the presence of a slight amount of water, the base and/or the base precursor are preferably incorporated into the dye-fixing element because storability of the light-sensitive material can be increased.

Further, a combination of a difficultly soluble metal compound with a compound (called complex-forming compound) capable of complex formation reaction with the metal ions constituting the difficultly soluble metal compound described in EP-A-210660 and U.S. Pat. No. 4,740,445, and a compound which generates a base on electrolysis described in JP-A-61-232451 may also be used as the base precursor. Particularly, the former method is effective. It is advantageous to add the difficultly soluble metal compound and the complex-forming compound separately to the light-sensitive material and to the dye-fixing element.

In the present invention, the light-sensitive material and/or the dye-fixing element may use various development stopping agents for the purpose of always obtaining a constant image against fluctuations in the processing temperature and in the processing time during development.

The term "development stopping agent" as used herein means a compound which smoothly neutralizes or reacts with the base after proper development to reduce the concentration of the base in the layer to thereby stop the development or a compound which interacts with silver or silver salt to inhibit the development. More specifically, the development stopping agent includes acid precursors which release an acid on heating, electrophilic compounds which cause substitution reaction with the base present together on heating, nitrogen-containing heterocyclic compounds, mercapto compounds and precursors thereof. The development stopping agent is described in more detail in JP-A-62-253159 (pages (31) and (32)).

In the present invention, as the support of the light-sensitive material or the dye-fixing element, those used in the above-described color negative film, color reversal film or color paper may be used.

On the surface of the above-described support, a hydrophilic binder and a semiconductor metal oxide such as alumina sol or tin oxide, or an antistatic agent such as carbon black may be coated.

The method of exposing and recording an image on the light-sensitive material includes a method of exposing image information through electrical signals to light emitting diode or various lasers emitted, and a method of outputting image information on an image display such as a CRT, a liquid crystal display, an electroluminescense display or a plasma display and exposing it directly or through an optical system. More specifically, the exposure methods described in JP-A-2-129625, JP-A-5-176144, JP-A-5-199372 and JP-A-6-127021 may be used.

As the light source for use in recording an image on a light-sensitive material, light sources described in U.S. Pat. 4,500,626 (column 56), such as light emitting diode, lasers, CRT, may be used.

The magnetic recording layer which is preferably used in the present invention is described below.

The magnetic recording layer is provided by coating an aqueous or organic solvent-base coating solution prepared by dispersing magnetic particles in a binder, on a support.

The magnetic particle includes ferromagnetic iron oxide (e.g., $\gamma Fe_2O_3$), Co-doped $\gamma Fe_2O_3$, Co-doped magnetite, Co-containing magnetite, ferromagnetic chromium dioxide, ferromagnetic metal, ferromagnetic alloy, hexagonal Ba ferrite, Sr ferrite, Pb ferrite and Ca ferrite. Among these, Co-doped ferromagnetic iron oxide such as Co-doped $\gamma Fe_2O_3$ is preferred. The form of the magnetic particle may be any of acicular, rice grain-like, spherical, cubic and platy forms. The specific surface area as $S_{BET}$ is preferably 20 $m^2/g$ or more, more preferably 30 $m^2/g$ or more. The saturation magnetization (δs) of the ferromagnetic material is preferably from $3.0\times10^4$ to $3.0\times10^5$ A/m, more preferably from $4.0\times10^4$ to $2.5\times10^5$ A/m. The ferromagnetic particle may be subjected to surface treatment with silica and/or alumina or an organic material. Further, the ferromagnetic particle may be subjected to surface treatment with a silane coupling agent or a titanium coupling agent as described in JP-A-6-161032. Also, a magnetic particle having coated on the surface thereof an inorganic or organic material described in JP-A-4-259911 and JP-A-5-81652 may be used.

The binder for use in the magnetic particle includes a thermoplastic resin, a thermosetting resin, a radiation-curable resin, a reactive resin, an acid, alkali or biodegradable polymer, a natural polymer (e.g., cellulose derivative, saccharide derivative) and a mixture of these described in JP-A-4-219569. The above-described resin has a Tg of from −40° C. to 300° C. and a weight average molecular weight of from 2,000 to 1,000,000. Examples of the resin include vinyl-base copolymers, cellulose derivatives such as cellulose diacetate, cellulose triacetate, cellulose acetate propionate, cellulose acetate butyrate and cellulose tripropionate, acrylic resins and polyvinyl acetal resins, and gelatin is also preferably used. Among these, cellulose di(tri)acetate is preferred. The binder may cured by adding thereto an epoxy-base, aziridine-base or isocyanate-base cross-linking agent. Examples of the isocyanate-base cross-linking agent include isocyanates such as tolylene diisocyanate, 4,4'-diphenylrnethane diisocyanate, hexamethylene diisocyanate and xylylene diisocyanate, reaction products of an isocyanate with polyalcohol (e.g., a reaction product of 3 mol of tolylene diisocyanate with 1 mol of trimethylolpropane) and polyisocyanates produced by condensation of an isocyanate, and examples thereof are described in JP-A-6-59357.

The magnetic material is dispersed in the above-described binder by the method preferably using a kneader, a pin-type mill orpin-type mill or an annular-type mill as described in JP-A-6-35092 and these may also be preferably used in combination. The dispersants described in JP-A-5-088283 and other known dipersants may be used. The thickness of the magnetic recording layer is from 0.1 to 10 μm, preferably from 0.2 to 5 μm, more preferably from 0.3 to 3 μm. The weight ratio of the magnetic particle to the binder is preferably from 0.5:100 to 60:100, more preferably from 1:100 to 30:100. The coating amount of the magnetic particles is from 0.005 to 3 $g/m^2$, preferably from 0.01 to 2 $g/m^2$, more preferably from 0.02 to 0.5 $g/m^2$. The magnetic recording layer has a transmitted yellow density of preferably from 0.01 to 0.50, more preferably from 0.03 to 0.20, still more preferably from 0.04 to 0.15. The magnetic recording layer may be provided throughout the entire surface of or stripedly on the back surface of the photographic support by coating or printing. The magnetic recording layer may be coated by using air doctor, blade, air knife, squeeze, soaking, reverse roller, transfer roller, gravure, kiss, cast, spray, dip, bar or extrusion, and the coating solution described in JP-A-5-341436 is preferred.

The magnetic recording layer may be designed to have additional functions such as improvement of lubricity, control of curl, electrostatic charge prevention, prevention of adhesion or head abrasion, or other functional layers may be provided to undertake these functions. At least one or more of the particles is preferably an abrasive as an aspheric inorganic particle having a Mohs' hardness of 5 or more. The composition of the aspheric inorganic particle is preferably an oxide such as aluminum oxide, chromium oxide, silicon dioxide or titanium dioxide, a carbide such as silicon carbide or titanium carbide, or a fine particle of diamond. The abrasive may be subjected to surface treatment with a silane coupling agent or a titanium coupling agent. The particles may be added to a magnetic recording layer or may be overcoated on the magnetic recording layer (for example, as a protective layer or a lubricant layer). The binder used here may be those described above and it is preferably the same as the binder in the magnetic recording layer. The light-sensitive material having a magnetic recording layer is described in U.S. Pat. Nos. 5,336,589, 5,250,404,5,229,259, and 5,215,874 and EP-A-466130.

The polyester support which is preferably used in the present invention is described below,however, the details thereof including the light sensitive material,the processing, the cartridge and the working examples are described in JIII *Journal of Technical Disclosure* No. 94-6023, Japan Institute of Invention and Inovation Mar. 15, 1994). The polyester for use in the present invention is essentially constituted by a diol and an aromatic dicarboxylic acid. Examples of the aromatic dicarbolic acid include 2,6-naphthalenedicarboxylic acid, 1,5-naphthaenedicarboxylic acid, 1,4-naphthalene-dicarboxylic acid, terephthalic acid, isophthalic acid and phthalic acid,and examples of the diol include diethylene glycol, triethylene glycol, cyclohexanedimethanol, bisphenol A and bisphenol. The polymer polymerized from these includes homopolymers such as polyethylene terephthalate, polyethelene naphthalate and polycyclohexanedimethanol terephthalate. Among these, preferred is a polyester containing from 50 to 100 % of 2,6-naphthalenedicarboxylic acid. Particularly preferred is polyethylene 2,6-naphthalate. The average molecular weight is from about 5000 to 200,000. The polyester for use in the present invention has a Tg of 50° C. or higher, more preferably 90° C. or higher.

The polyester support is then subjected to heat treatment to render it difficult to have curling habit, at a heat treatment temperature of from 40° C. to less than Tg, more preferably from (Tg-20° C.) to less than Tg. The heat treatment may be conducted either at a constant temperature within the above-described range or while cooling. The heat treatment time is from 0.1 to 1,500 hours, more preferably from 0.5 to 200 hours. The support may be subjected to heat treatment either in the roll state or as a web on transportation. The surface may be made uneven (for example, by coating electrically conductive inorganic fine particles such as $SnO_2$ or $Sb_2O_5$ ) to improve the surface state. Also, it is preferred to make some designs such that the edges is knurled to slightly increase the height only of the edge., thereby preventing the difference in level due to the edge from imparting the evenness of support wound thereon. The heat treatment may be performed at any stage, such as after formation of support film, after surface treatment, after coating of a back layer (e.g., antistatic agent, slipping agent) or after coating of an undercoat layer. The preferred stage is after coating of an antistatic agent.

Into the polyester, an ultraviolet absorbent may be kneaded in. Furthermore, for preventing light piping, a commercially available paint or pigment for polyester, such as Diaresin produced by Mitsubishi Kasei Corporation or Kayaset produced by Nippon Kayaku Co., Ltd., may be mixed so as to attain the purpose.

The surface treatment is preferably performed so that the support can be bonded to the light-sensitive material constituent layer. Examples thereof include surface activation treatment such as chemical treatment, mechanical treatment, corona discharge treatment, flame treatment, ultraviolet light treatment, high frequency treatment, glow discharge treatment, active plasma treatment, laser treatment, mixed acid treatment and ozone oxidation treatment. Among these surface treatments, preferred are ultraviolet irradiation treatment, flame treatment, corona treatment and glow treatment.

The undercoating method is described below. The undercoating may be single layer coating or two or more layer coating. The binder for the undercoat layer includes a copolymer starting from a monomer selected from vinyl chloride, vinylidene chloride, butadiene, methacrylic acid, acrylic acid, itaconic acid and maleic anhydride, and in addition, polyethyleneimine, epoxy resin, grafted gelatin, nitrocellulose and gelatin. The compound which swells the support include resorcin and p-chlorophenol. The undercoat layer may contain a gelatin hardening agent and examples thereof include chromic salts (e.g., chrome alum), aldehydes (e.g., formaldehyde, glutaraldehyde), isocyanates, active halogen compounds (e.g., 2,4-dichloro-6-hydroxy-S-triazine), epichlorohydrin resin and active vinyl sulfone compounds. Further, the undercoat layer may contain an inorganic fine particle such as $SiO_2$ or $TiO_2$, or a polymethyl methacrylate copolymer fine particle (particle size: 0.01 to 10 $\mu$m), as a matting agent.

The antistatic agent which is preferably used in the present invention includes polymers containing a carboxylic acid, a carboxylate or a sulfonate, cationic polymers and ionic surface active agent compounds.

Most preferred antistatic agents are fine particles of at least one crystalline metal oxide having a volume resistivity of $10^7$ Ω·cm or less, more preferably $10^5$ Ω·cm or less and a particle size of from 0.001 to 1.0 $\mu$m, selected from ZnO, $TiO_2$, $SnO_2$, $Al_2O_3$, $In_2O_3$, $SiO_2$, MgO, BaO, $MoO_3$ and $V_2O_5$, or of a composite oxide thereof (e.g., Sb, P, B, In, S, fine ), and fine particles of a sol-like metal oxide or of a composite oxide thereof. The content of the antistatic agent in the light-sensitive material is preferably from 5 to 500 $mg/m^2$ more preferably from 10 to 350 mg/m . The ratio of the electrically conductive crystalline oxide or a composite oxide thereof to the binder is preferably from 1/300 to 100/1, more preferably from 1/100 to 100/5.

The light-sensitive material of the present invention preferably has slipperiness. The slipping agent-containing layer is preferably provided on both of the light-sensitive layer surface and the back surface. The slipperiness is preferably, in terms of a coefficient of dynamic friction, from 0.01 to 0.25. This value is determined by transporting the light-sensitive material at a speed of 60 cm/min (25° C., 60% RH) against a stainless steel ball having a diameter of 5 mm. In this evaluation, even when the other party is changed to the light-sensitive layer surface, a value almost on the same level is obtained.

The slipping agent which can be used in the present invention includes polyorganosiloxane, a higher fatty acid amide, a higher fatty acid metal salt and an ester of a higher fatty acid with a higher alcohol. Examples of the polyorgano-siloxane include polydimethylsiloxane, polydimethylsiloxane, polystyrylmethylsiloxane and polymethylphenylsiloxane. The layer to which the slipping agent is added is preferably an outermost layer of the emulsion layers or a back layer. In particular, polydimethylsiloxane and an ester having a long chain alkyl group are preferred.

The light-sensitive material of the present invention preferably contains a matting agent. The matting agent may be provided either on the emulsion surface or on the back surface, but it is particularly preferably added to the outermost layer on the emulsion layer side. The matting agent may be either soluble or insoluble in the processing solution, and preferably, both of these two kinds of matting agents are used in combination. For example, polymethyl methacrylate, poly(methyl methacrylate/methacrylic acid =9/1 or 5/5 (by mol)) and polystyrene particles are preferred. The particle size is preferably from 0.8 to 10 $\mu$m, the particle size distribution is preferably narrower, and 90% by number or more of all particles preferably have a size between 0.9 and 1.1 times the average particle size. In order to increase the matting property, fine particles having a particle size of 0.8 $\mu$m or less are preferably added at the same time and examples thereof include polymethyl methacrylate (0.2 $\mu$m), poly(methyl methacrylate/methacrylic acid =9/1 (by mol), 0.3 $\mu$m), polystyrene particles (0.25 $\mu$m) and colloidal silica (0.03 $\mu$m).

The film patrone which is preferably used in the present invention is described below. The patrone for use in the present invention may be mainly formed of either a metal or synthetic plastic.

Preferred plastic materials are polystyrene, poly-ethylene, polypropylene and polyphenyl ether. The patrone for use in the present invention may further contain various antistatic agents and preferred examples thereof include carbon black, metal oxide particles, nonionic, anionic, cationic and betaine surface active agents, and polymers. The patrone imparted with the antistatic property is described in JP-A-1-312537 and JP-A-1-312538. In particular, the resistance at 25° C. and 25% RH is preferably $10^{12}$ Ω or less. Usually, the plastic patrone is produced using a plastic having kneaded therein carbon black or a pigment so as to give light-shielding property. The patrone may be in a 135 size currently used but, in achieving down-sizing of camera, it is also effective to reduce the cartridge size from 25 mm in the current 135 size to 22 mm or less. The volume of the patrone case is preferably 30 $cm^3$ or less, more preferably 25 $cm^3$ or less. The weight of plastics used in the patrone and the patrone case is preferably from 5 to 15 g.

A patrone which takes off the film by the rotation of a spool may be used. Also, the patrone may have such a constitution that a film leading end is housed in the patrone body and the film leading end is taken off from the port part of the patrone to the outside by rotating the spool shaft in the film delivery direction. These are disclosed in U.S. Pat. Nos. 4,834,306 and 5,226,613. The photographic film for use in the present invention may be a so-called green film before development or a developed photographic film. Also, a green film and a developed photographic film may be housed in the same new patrone or in different patrones.

The present invention is described below in greater detail with reference to the Examples, however, the present invention should not be construed as being limited thereto.

EXAMPLE 1

Samples containing a metal complex of the photographical useful compound for use in the present invention or a controlcompound as shown in Table 1 and having the following constitution were prepared.

TABLE 1

| Sample No. | Compound |
|---|---|
| 101 | — |
| 102 | PZD-1 |
| 103 | PZD-2 |
| 104 | (11) |
| 105 | (27) |
| 106 | (28) |
| 107 | (29) |
| 108 | (30) |
| Constitution of Sample: | |
| Gelatin | 2.0 g/m$^2$ |
| [1,1'-Methylenebis(sulfonyl)]bis-ethene | 2% of total gelatin amount |
| Coupler A | 0.55 g/m$^2$ |
| Tricresyl phosphate | 0.34 g/m$^2$ |
| Silver iodobromide emulsion (average grain size: 0.66 μm, silver iodide content in halogen: 8.9%) | as silver 0.64 g/m$^2$ |
| Gelatin | 3.2 g/m$^2$ |
| Compound for use in the present invention or control compound | 0.4 mmol/m$^2$ |
| Gelatin | 3.0 g/m$^2$ |
| Support (triacetyl cellulose) | |

Metal Complexes (11), (27), (28) and (29) of the photographically useful compounds for use in the present invention and Control Compounds PZD-1 and PZD-2 each was introduced into the sample as a solid dispersion. The solid dispersion was performed as follows. Into a ⅛ gallon-size vessel, 5 mmol of a compound to be dispersed, Demole SNB produced by Kao Corporation in a ½ weight of the compound, 20 ml of water and 100 g of zirconia oxide beads (diameter: 0.5 mm) were charged, and the mixture was dispersed using a sand grinder TSG-1/8-4U manufactured by AIMEX, at a revolution of 1,500 per minute for 2 hours. After the dispersion, the beads were removed by filtration to obtain a dispersion solution.

The fine grains in each dispersion solution had an average grain size as shown in Table 2. The content of the compound in each dispersion solution was obtained, in the case of the compound for use in the present invention, by determining the metal ion in a homogeneous solution obtained by the wet ashing method, according to the atomic absorption method, and in the case of the control compound, by dissolving it in dimethylformamide and determining the solution by liquid chromatograpgy.

TABLE 2

| Compound | Grains Size (μm) |
|---|---|
| PZD-1 | 0.49 |
| PZD-2 | 0.58 |
| (11) | 0.44 |
| (27) | 0.55 |
| (28) | 0.38 |
| (29) | 0.51 |
| (30) | 0.46 |

Coupler A

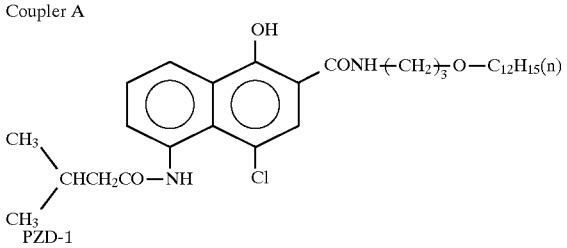

PZD-1

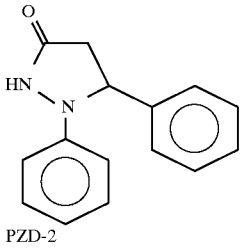

PZD-2

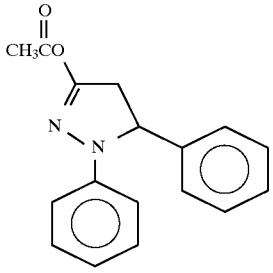

Each sample obtained above was wedgewise exposed to a light source in black body radiation having an energy distribution of 4,800°K., subjected to the development which will be described later, and measured on the cyan absorption density through a red filter to obtain a characteristic curve.

Assuming that the minimum density of Sample 101 is $D_0$, and the density and the minimum density of each sample at an exposure amount necessary for giving a density of (the minimum density $D_0$+0.5) in Sample 101 were D and Dm, respectively, ΔD as an index for the development acceleration effect and ΔF as an index for the minimum density (fog) are defined as follows:

$$\Delta D=(D-Dm)/0.5$$

$$\Delta F=Dm-D_0$$

The development process and the processing solution composition for Samples 101 to 108 are shown below.

| Processing | Temperature (°C.) | Time (sec) |
|---|---|---|
| Color Development | 45 | 30 |
| Bleach-fixing | 40 | 60 |
| Water washing (1) | 40 | 15 |
| Water washing (2) | 40 | 15 |
| Water washing (3) | 40 | 15 |
| Stabilization | 40 | 15 |
| Drying | 80 | 60 |

(The water washing was performed in a three-tank counter-current system from (3) to (1).)

| (Color Developer) | Tank Solution (g) |
|---|---|
| Sodium sulfite | 4.0 |
| Potassium carbonate | 37.2 |
| Potassium bromide | 4.0 |
| Potassium iodide | 1.3 mg |
| Disodium N,N-bis(sulfonatoethyl)-hydroxylamine | 13.2 |
| 2-Methyl-4-[N-ethyl-N-(β-hydroxyethyl)-amino] aniline sulfate | 11.0 |
| 2,6-Pyridinedicarboxylic acid | 8.4 |

Water was added to make a total weight of 1 ℓ and the pH was adjusted to 10.05 by potassium hydroxide and sulfuric acid.

| (Bleach-Fixing Solution) | Tank Solution (mol) |
|---|---|
| Ethylenediamine-(2-carboxyphenyl)-N,N',N'-triacetic acid | 0.17 |
| Ferric nitrate nonahydrate | 0.15 |
| Ammonium thiosulfate | 1.25 |
| Ammonium sulfite | 0.10 |
| Metacarboxybenzenesulfinic acid | 0.05 |

Water was added to make 1 P and the pH was adjusted to 5.8 by acetic acid and aqueous ammonia.

(Water Washing)

Tap water was passed through a mixed bed column filled with an H-type strongly acidic cation exchange resin (Amberlite IR120B, produced by Rohm and Haas) and an OH-type anion exchange resin (Amberlite IR-400, produced by the same company) to reduce the calcium and magnesium ion concentrations each to 3 mg/ℓ or less and then thereto 20 mg/ℓ of sodium isocyanurate dichloride and 0.15 g/ℓ of sodium sulfate were added. The resulting solution had a pH of from 6.5 to 7.5.

| (Stabilizing Solution) | Tank Solution (g) |
|---|---|
| Sodium p-toluenesulfinate | 0.03 |
| Polyoxyethylene-p-monononylphenyl ether (polymerization degree: 10) | 0.2 |
| Disodium ethylenediaminetetraacetate | 0.05 |
| 1,2,4-Triazole | 1.3 |
| 1,4-Bis(1,2,4-triazo1-1-ylmethyl)-piperazine | 0.75 |
| 1,2-Benzoisothiazolin-3-one | 0.10 |

Water was added to make 1 e and the pH was 8.5.

The test results are shown in Table 3. The compounds for use in the present invention gave a higher color density due to their development acceleration action in a short-time color development processing substantially without causing increase in the minimum density. Accordingly, the method of the present invention is proved to be a useful fundamental technique for imparting rapid proccessability to the practical light-sensitive material having a multi-layer structure.

TABLE 3

| Sample No. | Compound | ΔD | ΔF | Remarks |
|---|---|---|---|---|
| 101 | — | 1.00 | 0.00 | Comparison |
| 102 | PZD-1 | 1.22 | 0.12 | Comparison |
| 103 | PZD-2 | 1.02 | 0.02 | Comparison |
| 104 | (11) | 1.18 | 0.04 | Invention |
| 105 | (27) | 1.15 | 0.02 | Invention |
| 106 | (28) | 1.20 | 0.04 | Invention |
| 107 | (29) | 1.22 | 0.05 | Invention |
| 108 | (30) | 1.25 | 0.04 | Invention |

EXAMPLE 2

Samples 102 and 106 to 108 each was subjected to color development using a color developer prepared in the same manner as in example 1 except for excluding only 2,6-pyridine-dicarbolic acid from the color developer in Example 1. The subsequent processing and the measurement were performed thoroughly in the same manner as in Example 1 and the results obtained are shown in Table 4.

The samples containing the compound for use in the present invention provided substantially no development acceleration effect in the color development processing with a color developer free of water-soluble chelating agent. This reveals that the compound for use in the present invention in Example 1 caused the chelate exchange reaction with the water-soluble chelating agent to exert its development acceleration action.

TABLE 4

| Sample No. | Compound | ΔD | ΔF | Remarks |
|---|---|---|---|---|
| 102 | PZD-1 | 1.25 | 0.14 | Comparison |
| 106 | (28) | 1.02 | 0.00 | Invention |
| 107 | (29) | 1.02 | 0.02 | Invention |
| 108 | (30) | 1.04 | 0.03 | Invention |

EXAMPLE 3

A paired set of each of Samples 102 and 106 to 108 was prepared and one was sealed in an atmosphere at 25° C. and a relative humidity of 60% and aged in a refrigerator set at −15° C. the other was aged at 40° C. and a relative humidity of 70%, 7 days, and thereafter, these were subjected to the same processing and the same measurement as in Example 1.

The test results are shown in Table 5. The compounds for use the present invention stably exhibited their action even after aging under forced conditions. According to the method of the present invention, stability on storage and rapid reactivity on development can be achieved.

TABLE 5

| Sample No. | Compound | Aging Condition | ΔD | ΔF | Remarks |
|---|---|---|---|---|---|
| 102 | PZD-1 | refrigerator | 1.24 | 0.11 | Comparison |
| | | 40° C., 70% | 1.29 | 0.32 | |

TABLE 5-continued

| Sample No. | Compound | Aging Condition | ΔD | ΔF | Remarks |
|---|---|---|---|---|---|
| 106 | (28) | refrigerator | 1.19 | 0.02 | Invention |
| | | 40° C., 70% | 1.22 | 0.05 | |
| 107 | (29) | refrigerator | 1.21 | 0.05 | Invention |
| | | 40° C., 70% | 1.24 | 0.03 | |
| 108 | (30) | refrigerator | 1.26 | 0.04 | Invention |
| | | 40° C., 70% | 1.28 | 0.04 | |

EXAMPLE 4

1) Support

The support used in this Example was prepared according to the following method.

A polyethylene-2,6-naphthalate polymer (100 parts by weight) and 2 parts by weight of Tinuvin P.326 (produced by Ciba-Geigy AG) as an ultraviolet absorbent were dried, melted at 300° C., extruded from a T-die, stretched at 140° C. to 3.3 times in the machine direction, then stretched at 130° C. to 3.3 times in the transverse direction and further heat set at 250° C. for 6 seconds to obtain a PEN film having a thickness of 90 μm. To the resulting PEN film, a blue dye, a magenta dye and a yellow dye (Compounds I-1, I-4, I-6, I-24, 1-26, I-27 and II-5 described in *JIII Journal of Technical Disclosure,* No. 94-6023) were added in an appropriate amount. Further, the film was wound around a stainless steel core having a diameter of 20 cm and imparted with heat history at 110° C. for 48 hours, thereby obtaining a support difficult to have curling habit.

2) Coating of undercoat layer

Both surfaces of the support obtained above were subjected to corona discharge treatment, UV discharge treatment and further glow discharge treatment, and on one surface, an undercoating solution containing 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$ and 0.02 g/m$^2$ of a polyamide-epichlorohydrin polycondensate was coated (10 ml/m$^2$, by a bar coater) to provide an undercoat layer on the higher temperature side at the time of stretching. The drying was performed at 115° C. for 6 minutes (the rollers and the transportation device in the drying zone all were heated to 115° C.).

3) Coating of back layer

On the surface of the support opposite to the surface coated with the undercoating solution, an antistatic layer, a magnetic recording layer and a slipping layer each having the following composition were coated as a back layer.

3-1) Coating of antistatic layer

Together with 0.05 g/m$^2$ of gelatin, 0.02 g/m$^2$ of $(CH_2{=}CHSO_2CH_2CH_2NHCO)_2CH_2$, 0.005 g/m$^2$ of poly (polymerization degree: 10)oxyethylene-p-nonylphenol and 0.005 g/m$^2$ of resorcinol, 0.2 g/m$^2$ of a dispersion (secondary coagulated particle size: about 0.08 μm) of fine particle powder having a resistivity of 5 Ω·cm of a tin oxide-antimony oxide composite having an average particle diameter of 0.005 μm was coated.

3-2) Coating of magnetic recording layer.

Co-γ-iron oxide (0.06 g/m$^2$) (specific surface area: 43 m$^2$/g; major axis: 0.14 μm; minor axis: 0.03 μm; saturated magnetization: 89 emu/g; $Fe^{30\ 2}/Fe^{30\ 3}$=6/94; the surface being treated with aluminum oxide and silicon oxide each in an amount of 2 wt% based on the iron oxide) subjected to covering treatment with 3-poly(polymerization degree: 15) oxyethylene-propyloxytrimethoxysilane (15 wt%) was coated using 1.2 g/m$^2$ of diacetyl cellulose (the iron oxide being dispersed by an open kneader and a sand mill), 0.3 g/m$^2$ of $C_2H_5C(CH_2OCONH\text{-}C_6H_3(CH_3)NCO)_3$ as a hardening agent, and acetone, methyl ethyl ketone and cyclohexanone as solvents by means of a bar coater to obtain a magnetic recording layer having a thickness of 1.2 μm. Thereto, silica particles (0.3 μm) as a matting agent and an aluminum oxide (0.15 μm) covered with 3-poly(polymerization degree: 15)oxyethylene-propyloxytrimethoxy-silane (15 wt%), as an abrasive, were added each to give a coverage of 10 mg/m$^2$. The drying was performed at 115° C. for 6 minutes (the rollers and the transportation device in the drying zone all were heated to 115° C.). Increase in the color density $D^B$ of the magnetic recording layer with X-light (blue filter) was about 0.1, the saturated magnetization moment of the magnetic recording layer was 4.2 emu/m$^2$, the coercive force was $7.3\times10^4$ A/m and the angular ratio was 65%.

3-3) Preparation of slipping layer

Diacetyl cellulose (25 mg/m$^2$) and a mixture of $C_6H_{13}CH(OH)C_{10}H_{20}COOC_{40}H_{81}$ (Compound a, 6 mg/m$^2$) and $C_{50}H_{101}O(CH_2CH_2O)_{16}H$ (Compound b, 9 mg/m$^2$) were coated. This mixture was prepared by melting these compounds in xylene/propylene glycol monomethyl ether (1/1 by volume) at 105° C. and pouring and dispersing the melt in propylene glycol monomethyl ether (10-fold amount) at room temperature, and added after formulating it into a dispersion (average particle size: 0.01 μm) in acetone. Silica particles (0.3 μm) as a matting agent and aluminum oxide (0.15 μm) covered with 3-poly(polymerization degree: 15)oxyethylene-propyloxy-trimethoxysilane (15 wt%), as an abrasive, were added each to have a coverage of 15 mg/m$^2$. The drying was performed at 115° C. for 6 minutes (the rollers and the transportation device in the drying zone all were heated to 115° C.). The thus-provided slipping layer had excellent properties such that the coefficient of dynamic friction was 0.06 (5-mmφ stainless steel ball; load: 100 g; speed: 6 cm/min), the coefficient of static friction was 0.07 (by clip method) and the coefficient of dynamic friction between the emulsion surface which will described later and the slipping layer was 0.12.

4) Coating of light-sensitive layer

The layers each having the following composition were coated to overlay one on another on the side opposite to the back layer to prepare a color negative film. This film was designated as Sample 111.

(Composition of light-sensitive layer)

The main materials used in each layer are classified as follows.

ExC: cyan coupler

ExM: magenta coupler

ExY: yellow coupler

ExS: sensitizing dye

UV: ultraviolet absorbent

HBS: high-boiling point organic solvent

H: gelatin hardening agent

Numerals corresponding to respective components show coating amounts expressed by the unit of g/m$^2$ and in case of silver halide, they show coating amounts in terms of silver. With respect to sensitizing dyes, the coating amount is shown by the unit mol per mol of silver halide in the same layer.

(Sample 111)

| | | |
|---|---|---|
| First Layer (first antihalation layer) | | |
| Black colloidal silver | as silver | 0.07 |
| Gelatin | | 0.65 |
| Second Layer (second antihalation layer) | | |
| Black colloidal silver | as silver | 0.08 |
| Gelatin | | 1.01 |
| ExM-1 | | 0.12 |
| ExF-1 | | $2.0 \times 10^{-3}$ |
| Solid Disperse Dye ExF-2 | | 0.030 |
| Solid Disperse Dye ExF-3 | | 0.040 |
| HBS-1 | | 0.15 |
| HBS-2 | | 0.02 |
| Third Layer (interlayer) | | |
| ExC-2 | | 0.05 |
| Polyethylacrylate latex | | 0.20 |
| Gelatin | | 0.70 |
| Fourth Layer (low-sensitivity red-sensitive emulsion layer) | | |
| Silver Iodobromide Emulsion A | as silver | 0.21 |
| Silver Iodobromide Emulsion B | as silver | 0.23 |
| Silver Iodobromide Emulsion C | as silver | 0.10 |
| ExS-1 | | $3.8 \times 10^{-4}$ |
| ExS-2 | | $1.6 \times 10^{-5}$ |
| ExS-3 | | $5.2 \times 10^{-4}$ |
| ExC-1 | | 0.17 |
| ExC-2 | | 0.02 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 1.10 |
| Fifth Layer (medium-sensitivity red-sensitive emulsion layer) | | |
| Silver Iodobromide Emulsion C | as silver | 0.15 |
| Silver Iodobromide Emulsion D | as silver | 0.47 |
| ExS-1 | | $4.0 \times 10^{-4}$ |
| ExS-2 | | $2.1 \times 10^{-5}$ |
| ExS-3 | | $5.7 \times 10^{-4}$ |
| ExC-1 | | 0.13 |
| ExC-2 | | 0.02 |
| ExC-3 | | 0.03 |
| ExC-4 | | 0.10 |
| ExC-5 | | 0.02 |
| ExC-6 | | 0.01 |
| Cpd-4 | | 0.030 |
| Cpd-2 | | 0.05 |
| HBS-1 | | 0.10 |
| Gelatin | | 0.75 |
| Sixth Layer (high-sensitivity red-sensitive emulsion layer) | | |
| Silver Iodobromnide Emulsion E | as silver | 1.31 |
| ExS-1 | | $2.5 \times 10^{-4}$ |
| ExS-2 | | $1.1 \times 10^{-5}$ |
| ExS-3 | | $3.6 \times 10^{-4}$ |
| ExC-1 | | 0.11 |
| ExC-3 | | 0.12 |
| ExC-6 | | 0.020 |
| ExC-7 | | 0.010 |
| Cpd-2 | | 0.050 |
| Cpd-4 | | 0.020 |
| HBS-1 | | 0.22 |
| HBS-2 | | 0.060 |
| Gelatin | | 1.40 |
| Seventh Layer (interlayer) | | |
| Cpd-1 | | 0.060 |
| Solid Disperse Dye ExF-4 | | 0.030 |
| HBS-1 | | 0.039 |
| Polyethylacrylate latex | | 0.14 |
| Gelatin | | 1.10 |
| Eighth Layer (low-sensitivity green-sensitive emulsion layer) | | |
| Silver Iodobromide Emulsion F | as silver | 0.22 |

-continued

| | | |
|---|---|---|
| Silver Iodobromide Emulsion G | as silver | 0.35 |
| ExS-7 | | $1.4 \times 10^{-4}$ |
| ExS-8 | | $6.2 \times 10^{-4}$ |
| ExS-4 | | $2.7 \times 10^{-5}$ |
| ExS-5 | | $7.0 \times 10^{-5}$ |
| ExS-6 | | $2.7 \times 10^{-4}$ |
| ExM-3 | | 0.415 |
| ExM-4 | | 0.086 |
| ExY-1 | | 0.070 |
| ExY-5 | | 0.0069 |
| HBS-1 | | 0.30 |
| HBS-3 | | 0.015 |
| Cpd-4 | | 0.010 |
| Gelatin | | 0.95 |
| Ninth Layer (medium-sensitivity green-sensitive emulsion layer) | | |
| Silver Iodobromide Emulsion G | as silver | 0.48 |
| Silver Iodobromide Emulsion H | as silver | 0.48 |
| ExS-4 | | $4.8 \times 10^{-5}$ |
| ExS-7 | | $2.1 \times 10^{-4}$ |
| ExS-8 | | $9.3 \times 10^{-4}$ |
| ExC-8 | | 0.0020 |
| ExM-3 | | 0.120 |
| ExM-4 | | 0.035 |
| ExY-1 | | 0.010 |
| ExY-4 | | 0.010 |
| ExY-5 | | 0.0050 |
| Cpd-4 | | 0.011 |
| HBS-1 | | 0.14 |
| HBS-3 | | $4.4 \times 10^{-3}$ |
| Gelatin | | 0.81 |
| Tenth Layer (high-sensitivity green-sensitive emulsion layer) | | |
| Silver Iodobromide Emulsion I | as silver | 1.29 |
| ExS-4 | | $4.5 \times 10^{-5}$ |
| ExS-7 | | $1.2 \times 10^{-4}$ |
| ExS-8 | | $5.3 \times 10^{-4}$ |
| ExC-1 | | 0.021 |
| ExM-1 | | 0.010 |
| ExM-2 | | 0.030 |
| ExM-5 | | 0.0070 |
| ExM-6 | | 0.0050 |
| Cpd-3 | | 0.017 |
| Cpd-4 | | 0.040 |
| HBS-1 | | 0.25 |
| Polyethylacrylate latex | | 0.15 |
| Gelatin | | 1.33 |
| Eleventh Layer (yellow filter layer) | | |
| Yellow colloidal silver | as silver | 0.015 |
| Cpd-1 | | 0.16 |
| Solid Disperse Dye ExF-5 | | 0.060 |
| Solid Disperse Dye ExF-6 | | 0.060 |
| Oil-Soluble Dye ExF-7 | | 0.010 |
| HBS-1 | | 0.60 |
| Gelatin | | 0.60 |
| Twelfth Layer (low-sensitivity blue-sensitive emulsion layer) | | |
| Silver Iodobromide Emulsion J | as silver | 0.09 |
| Silver Iodobromide Emulsion K | as silver | 0.10 |
| Silver Iodobromide Emulsion L | as silver | 0.24 |
| ExS-9 | | $8.4 \times 10^{-4}$ |
| ExC-1 | | 0.03 |
| ExC-8 | | $7.0 \times 10^{-3}$ |
| ExY-1 | | 0.050 |
| ExY-2 | | 0.74 |
| ExY-3 | | 0.41 |
| ExY-4 | | 0.040 |
| Cpd-2 | | 0.10 |
| Cpd-4 | | 0.01 |
| Cpd-3 | | $4.0 \times 10^{-3}$ |
| HBS-1 | | 0.28 |
| Gelatin | | 2.11 |
| Thirteenth Layer (high-sensitivity blue-sensitive emulsion layer) | | |
| Silver Iodobromide Emulsion M | as silver | 0.58 |
| ExS-9 | | $3.5 \times 10^{-4}$ |
| ExY-2 | | 0.070 |
| ExY-3 | | 0.070 |

-continued

| | | |
|---|---|---|
| ExY-4 | | 0.0050 |
| Cpd-2 | | 0.10 |
| Cpd-3 | | $1.0 \times 10^{-3}$ |
| Cpd-4 | | 0.02 |
| HBS-1 | | 0.075 |
| Gelatin | | 0.56 |
| Fourteenth Layer (first protective layer) | | |
| Silver Iodobromide Emulsion N | as silver | 0.10 |
| UV-1 | | 0.13 |
| UV-2 | | 0.12 |
| UV-3 | | 0.15 |
| UV-4 | | 0.025 |
| ExF-8 | | 0.001 |
| ExF-9 | | 0.002 |
| HBS-1 | | $5.0 \times 10^{-2}$ |
| HBS-4 | | $5.0 \times 10^{-2}$ |
| Gelatin | | 1.8 |
| Fifteenth Layer (second protective layer) | | |
| H-1 | | 0.40 |
| B-1 (diameter: 1.7 μm) | | 0.04 |
| B-2 (diameter: 1.7 μm) | | 0.09 |
| B-3 | | 0.13 |
| ES-1 | | 0.20 |
| Gelatin | | 0.70 |

Further, in order to provide good preservability, proccessability, pressure resistance, antifungal/bactericidal property, antistatic property and coatability, W-1, W-2, W-3, B-4, B-5, B-6, F-1, F-2, F-3, F-4, F-5, F-6, F-7, F-8, F-9, F-10, F-11, F-12, F-13, F-14, F-15, F-16, F-17, F-18, iron salt, lead salt, gold salt, platinum salt, palladium salt, iridium salt or rhodium salt was appropriately added to each layer.

TABLE 6

| Emulsion | Average AgI Content (%) | Average Grain Size, Equivalent-Sphere Diameter (μm) | Coefficient of Variation in Grain Size (%) | Projected Area, Equivalent-Circle Diameter (μm) | Diameter/ Thickness Ratio | Planeness |
|---|---|---|---|---|---|---|
| A | 3.7 | 0.37 | 13 | 0.43 | 2.3 | 12 |
| B | 3.7 | 0.43 | 19 | 0.58 | 3.2 | 18 |
| C | 5.0 | 0.55 | 20 | 0.86 | 6.2 | 45 |
| D | 5.4 | 0.66 | 23 | 1.10 | 7.0 | 45 |
| E | 4.7 | 0.85 | 22 | 1.36 | 5.5 | 22 |
| F | 3.7 | 0.43 | 19 | 0.58 | 3.2 | 18 |
| G | 5.4 | 0.55 | 20 | 0.86 | 6.2 | 45 |
| H | 5.4 | 0.66 | 23 | 1.10 | 7.0 | 45 |
| I | 7.5 | 0.85 | 24 | 1.30 | 5.0 | 19 |
| J | 3.7 | 0.37 | 19 | 0.55 | 4.6 | 38 |
| K | 3.7 | 0.37 | 19 | 0.55 | 4.6 | 38 |
| L | 8.8 | 0.64 | 23 | 0.85 | 5.2 | 32 |
| M | 6.3 | 1.05 | 20 | 1.46 | 3.7 | 9 |
| N | 1.0 | 0.07 | — | — | 1.0 | — |

In Table 6:

(1) Emulsions J to M were subjected to reduction sensitization at the time of preparation of grains using thiourea dioxide and thiosulfonic acid according to the example of JP-A-2-191938 (corresponding to U.S. Pat. No. 5,061,614);

(2) Emulsions C to E, G to I and M were subjected to gold sensitization, sulfur sensitization and selenium sensitization in the presence of the spectral sensitizing dyes described in each light-sensitive layer and sodium thiocyanate according to the example of JP-A-3-237450 (corresponding to EP-A-443453);

(3) in the preparation of Emulsion A to M, low molecular weight gelatin was used according to the example of JP-A-1-158426;

(4) in Emulsions A to M, dislocation lines were observed through a high-pressure electron microscope as described in JP-A-3-237450 (corresponding to EP-A-443453); and (5) Emulsions A to E, G, H, J to M each contains an optimal amount of Rh, Ir and Fe. The planeness is defined by: $Dc/t^2$, wherein Dc is an average equivalent-circle diameter in the projected area of tabular grains and t is an average thickness of tabular grains.

Preparation of Dispersion of Organic Solid Disperse Dye

ExF-2 shown below was dispersed in the following manner. Namely, 21.7 ml of water, 3 ml of a 5% aqueous solution of sodium p-octylphenoxyethoxyethoxyethanesulfonate and 0.5 g of a 5% aqueous solution of p-octylphenoxypolyoxyethylene ether (polymerization degree: 10) were poured in a 700 ml-volume pot mill, then thereto 5.0 g of Dye ExF-2 and 500 ml of zirconium oxide beads (diameter: 1 mm) were added and the mixture was dispersed for 2 hours. The dispersion was performed using a BO-type vibrating ball mill manufactured by Chuo Koki K. K. After the dispersion, the content was taken out and thereto 8 g of a 12.5% aqueous gelatin solution was added and beads were removed by filtration to obtain a gelatin dispersion of the dye. The fine dye particles had an average particle diameter of 0.44 μm.

In the same manner, solid dispersions of ExF-3, ExF-4 and ExF-6 were obtained. The fine dye particles had an average particle diameter of 0.24 μm, 0.45 μm and 0.52 μm, respectively. ExF-5 was dispersed by the microprecipitation dispersion method described in Example 1 of EP-A-549489 and the average particle diameter thereof was 0.06 μm.

ExC-1
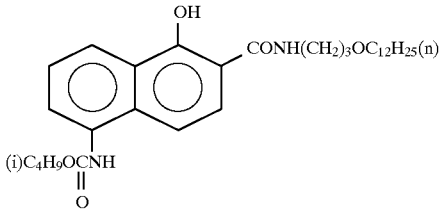
ExC-2
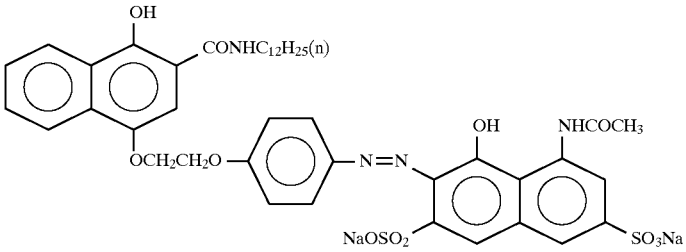
ExC-3
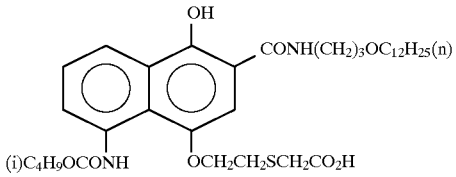
ExC-4
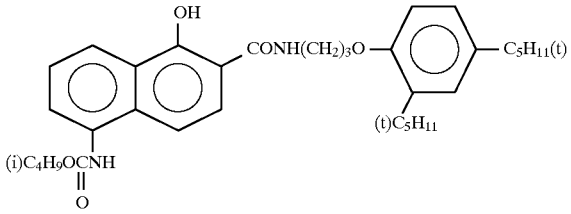
ExC-5
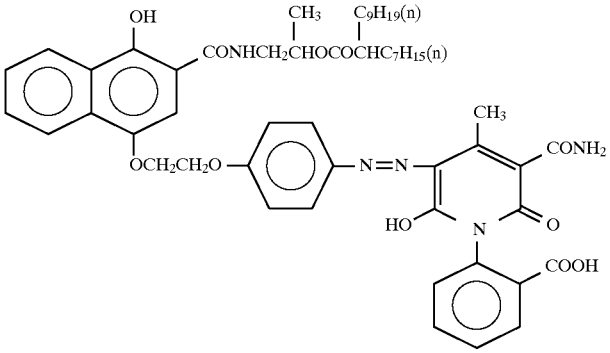

-continued
ExC-6
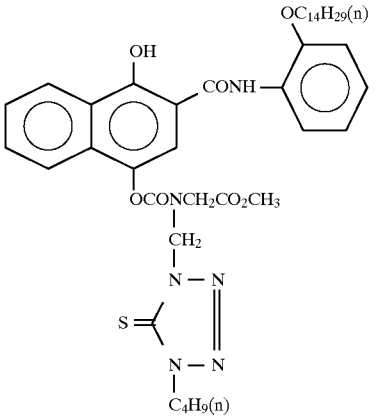
ExC-7
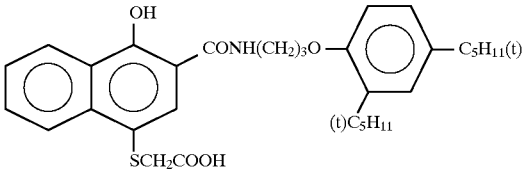
ExC-8
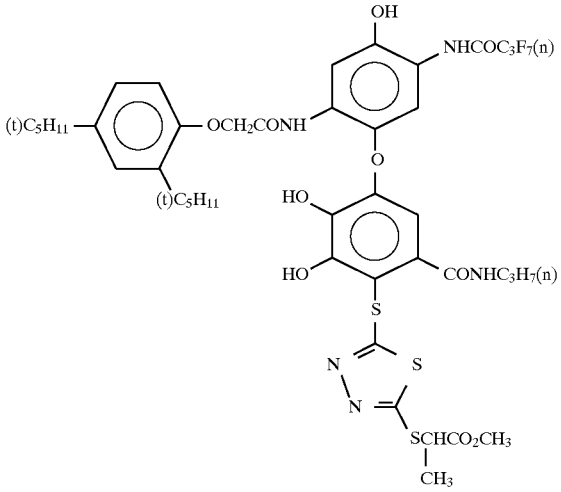
ExM-1
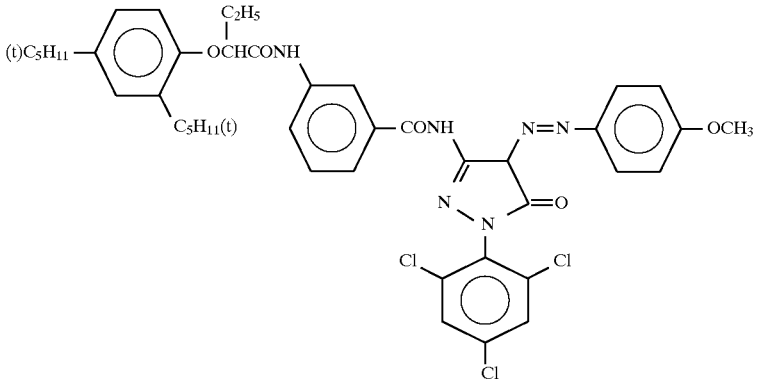

-continued
ExM-2
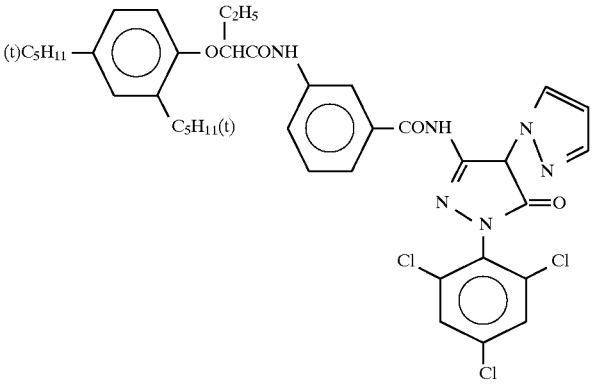
ExM-3
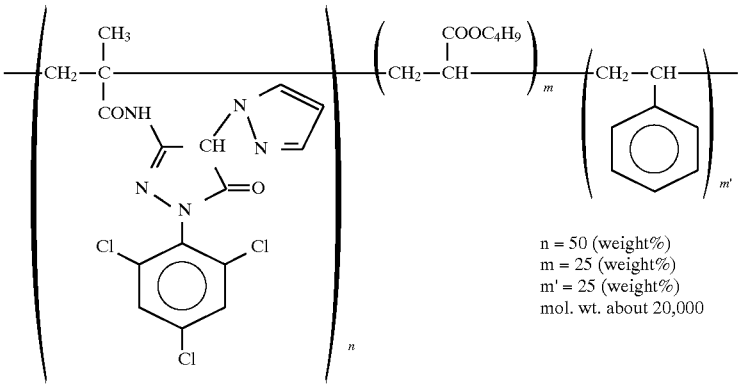
n = 50 (weight%)
m = 25 (weight%)
m' = 25 (weight%)
mol. wt. about 20,000
ExM-4
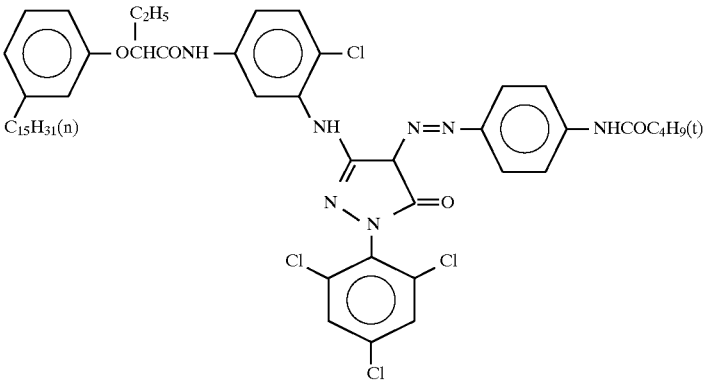
ExM-5
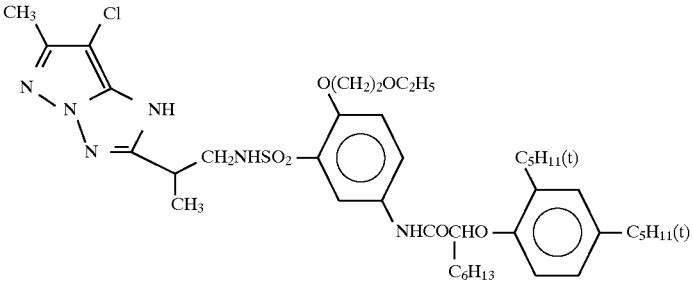

-continued
ExM-6
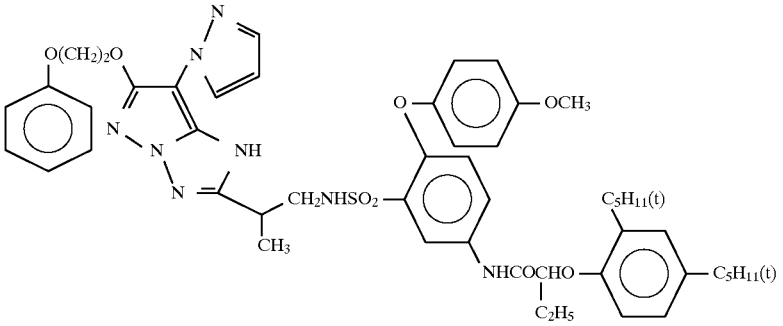
ExY-1
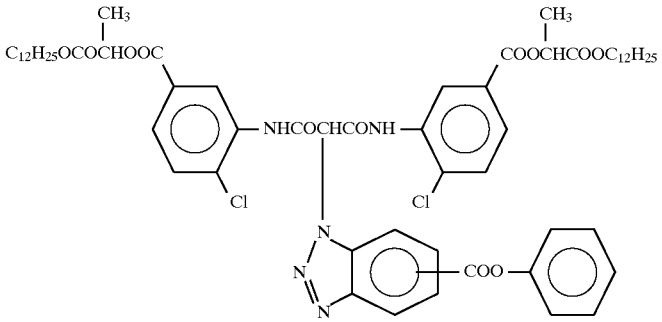
ExY-2
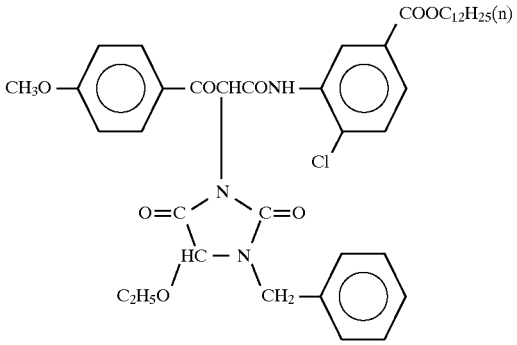
ExY-3
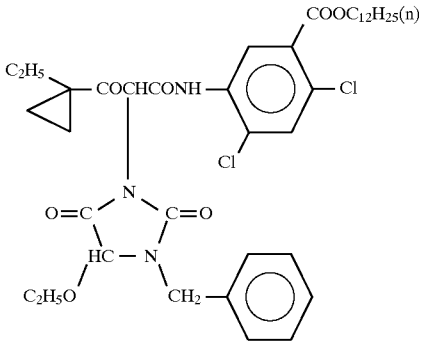

-continued
ExY-4
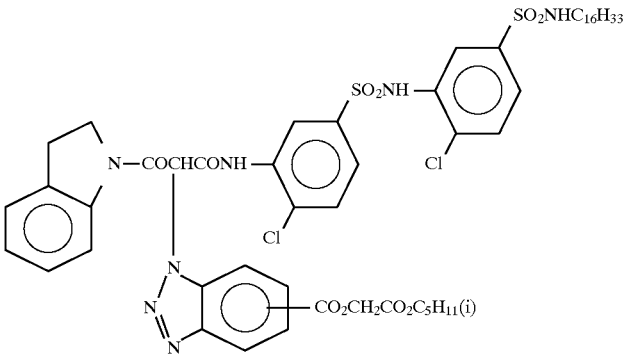
ExY-5
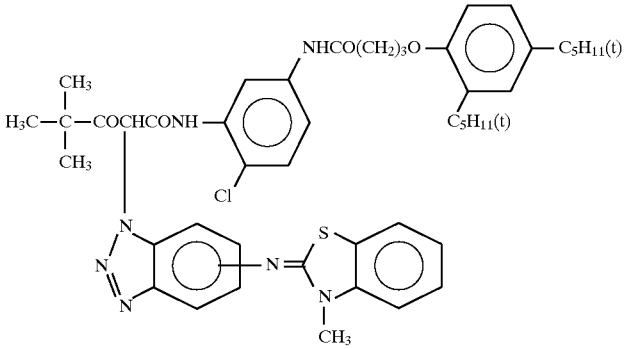
ExF-1
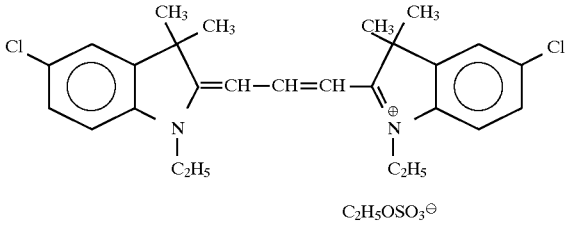
ExF-2
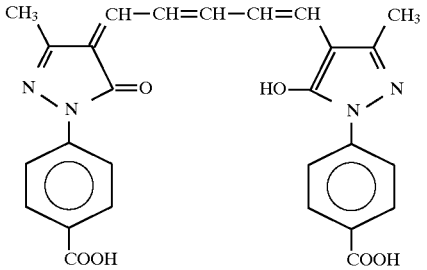
ExF-3
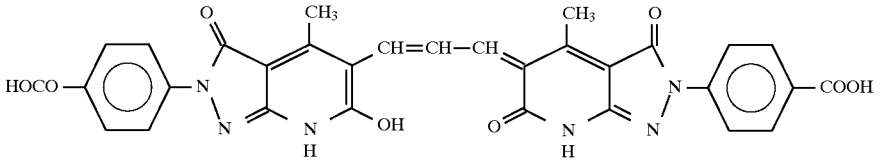

-continued
ExF-4
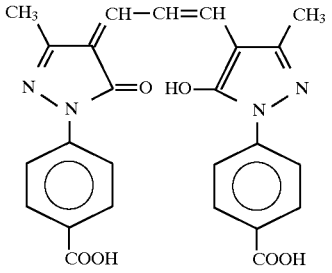
ExF-5
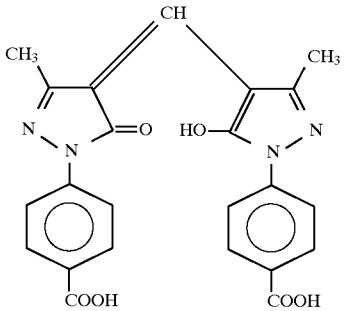
ExF-6
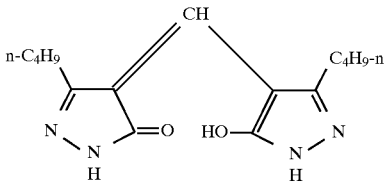
ExF-7
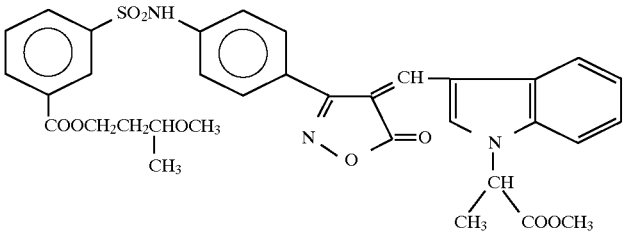
ExF-8
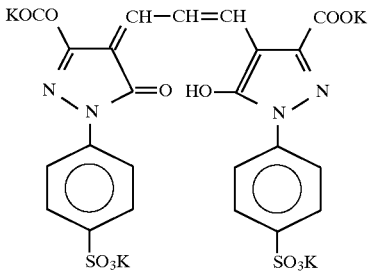

-continued
ExF-9
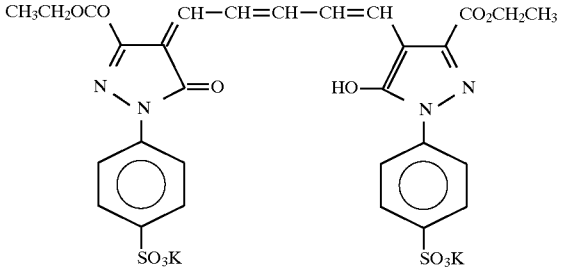
Cpd-1
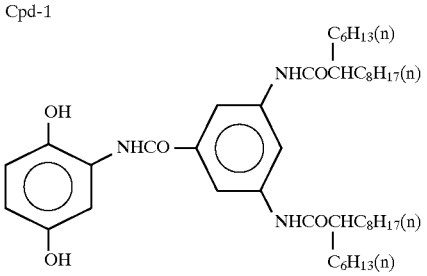
Cpd-2
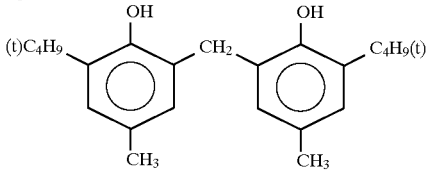
Cpd-3
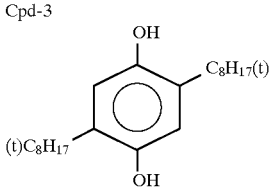
Cpd-4
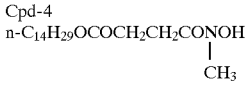
UV-1
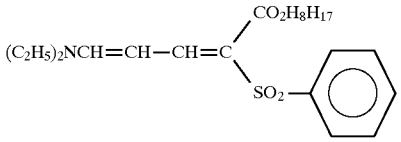
UV-2
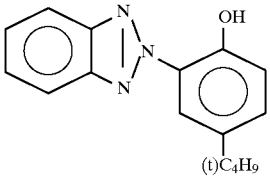
UV-4
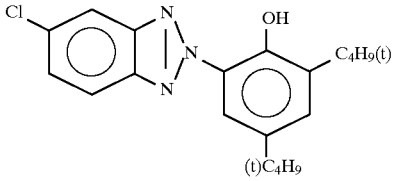

-continued
UV-3
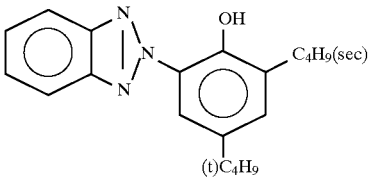
HBS-1
Tricresyl phosphate
HBS-2
Di-n-butyl phthalate
HBS-3
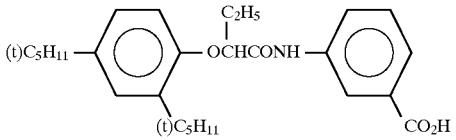
HBS-4
Tri(2-ethylhexyl) phosphate
ExS-1
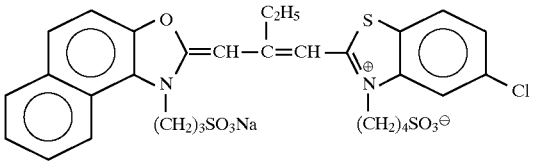
ExS-2
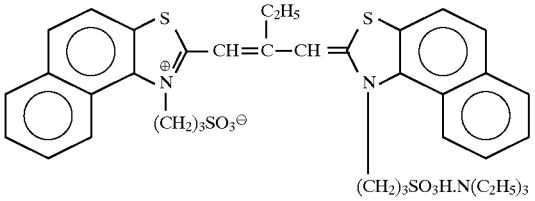
ExS-3
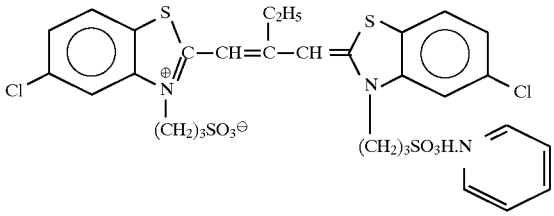
ExS-4
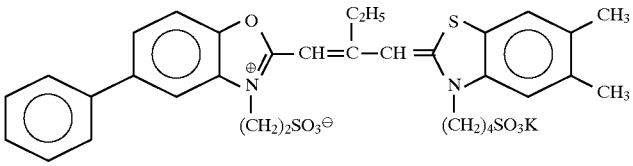
ExS-5
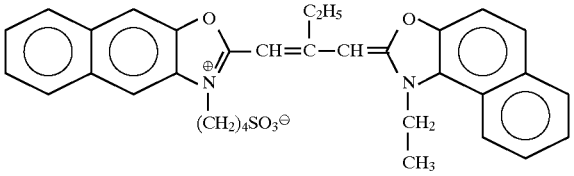

-continued
ExS-6
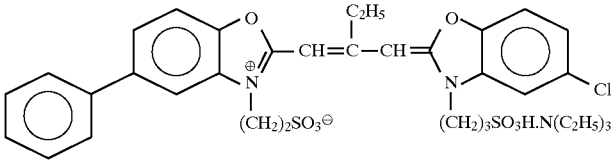
ExS-7
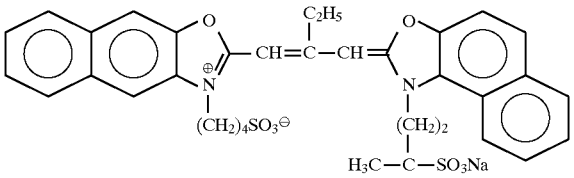
ExS-8
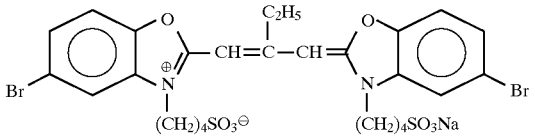
ExS-9
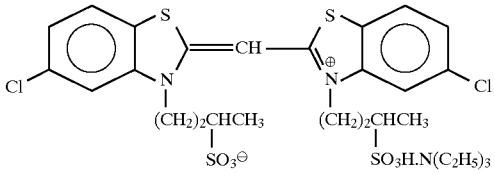
ES-1
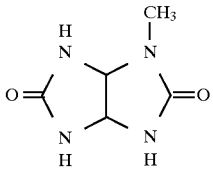
H-1
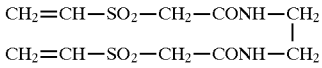
B-1
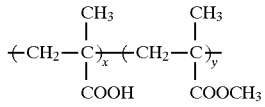
x/y = 10/90 (weight ratio)
Average molecular weight: about 35,000
B-2
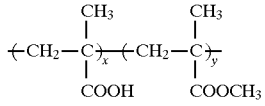
x/y = 40/60 (weight ratio)
Average molecular weight: about 20,000
B-3
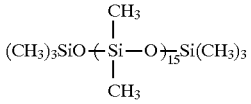

-continued
B-4
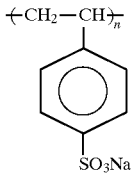
Average molecular weight: about 750,000
n = an integer
B-5
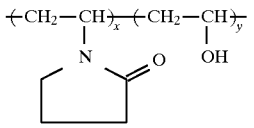
x/y = 70/30 (weight ratio)
Average molecular weight: about 17,000
B-6
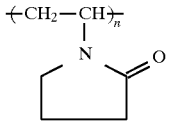
Average molecular weight: about 10,000
n = an integer
W-1
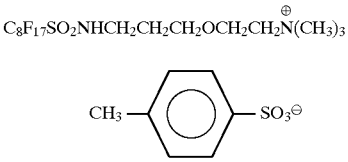
W-2
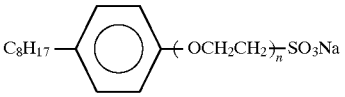
n = 2~4
W-3
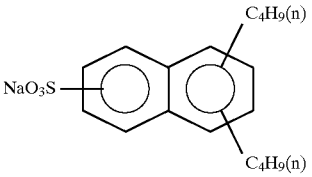
F-1
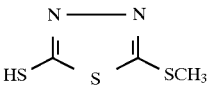
F-2
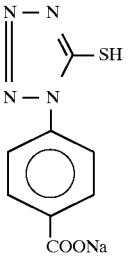

-continued
F-3
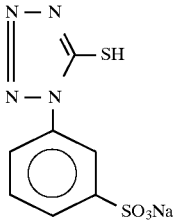
F-4
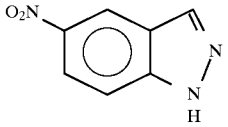
F-5
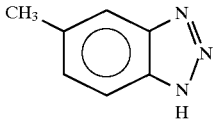
F-6
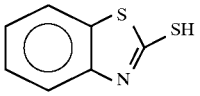
F-7
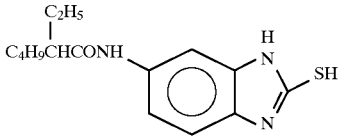
F-8
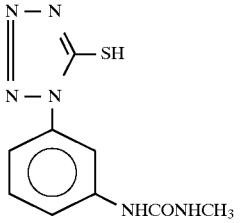
F-9
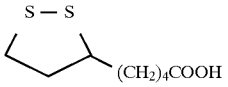
F-10
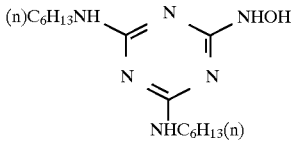
F-11
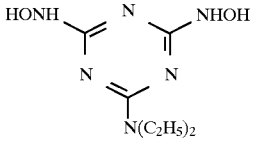

-continued

F-12

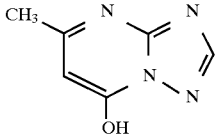

F-13

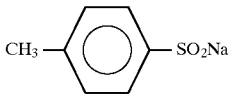

F-14

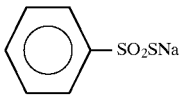

F-15

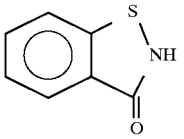

F-16

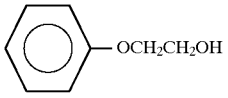

F-17

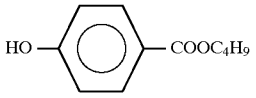

F-18

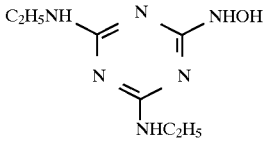

Samples 112, 113 and 114 were prepared by adding Metal Complex (28), (29) or (30) of the photographically useful compound for use in the present invention to each of the fourth, fifth, eighth and twelfth layers in an amount of 0.25 mmol/$m^2$. Each sample was exposed and developed in the same manner as in Example 1 except that the processing time in the color development process was changed to 60 seconds. After the processing, each sample was measured on the absorption density of cyan, magenta or yellow to obtain a characteristic curve. The conditions followed Status M.

In the characteristic curve obtained, for the logarithmic abscissa of the exposure amount, the points of densities of 0.25, 0.5, 1.0, 1.5 and 1.75 starting from the minimum density of the cyan, magenta or yellow absorption density were plotted and these points were approximated to a straight line by least square. The angle θ of the straight line obtained from the abscissa was determined and by defining tanθ as the gradation γ, the gradations γ of the cyan, magenta and yellow densities were named γ(C), γ(M) and γ(Y), respectively.

Then, assuming that the gradations of cyan, magenta and yellow densities of Sample 111 are $\gamma_0(C)$, $\gamma_0(M)$ and $\gamma_0(Y)$, the ratios (r(C), r(M) and r(Y)) of respective gradations γ of each sample were defined as follows.

$$r(C)=\gamma(C)/\gamma_0(C)$$

$$r(M)=\gamma(M)/\gamma_0(M)$$

$$r(Y)=\gamma(Y)/\gamma_0(Y)$$

The results are shown in Table 7.

TABLE 7

| Sample No. | r(C) | r(M) | r(Y) | Remarks |
|---|---|---|---|---|
| 111 | 1.00 | 1.00 | 1.00 | Comparison |
| 112 | 1.12 | 1.09 | 1.10 | Invention |
| 113 | 1.13 | 1.15 | 1.12 | Invention |
| 114 | 1.15 | 1.17 | 1.16 | Invention |

As seen from the results above, the method of the present invention is an effective means for increasing the gradation in the short-time development processing of a color negative film.

EXAMPLE 5

A sample the same as Sample 101 described in column 58 of U.S. Pat. No. 4,956,269 was prepared and designated as Sample 201. Then, Metal Complex (29) or (30) of the photographically useful compound for use in the present invention was added to each of the fourth, fifth, ninth, tenth and fifteenth layers in an amount of 0.20 mmol/$m^2$ to prepare Samples 202 and 203.

In the processing described in the above patent publication, the first development processing with a processing solution where 2 g of pentasodium nitrilo-N,N,N-trimethylene- phosphonate added to the first developer only was replaced by 8.4 g of 2,6-pyridinecarboxylic acid was designated as Processing A and the first development with the developer described in the patent publication was designated as Processing B.

Samples 201 to 203 each was wedgewise exposed in the same manner as in Example 1, subjected to Processing A for the development time of 4 minutes and 30 seconds, 5 minutes, 5 minutes and 30 seconds, or 6 minutes or to Processing B for the development time of 6 minutes, and thereafter processed in the same manner as described in the patent publication. As a result of comparison between the characteristic curves obtained, when Samples 202 and 203 containing the compound for use in the present invention were subjected to Processing A, a development acceleration effect in the short-time processing was observed. Thus, the method of the present invention was effective also on the color reversal film.

EXAMPLE 6

A sample the same as Sample 211 in Example 1 of JP-A-7-140616 was prepared and designated as Sample 301. Then, Metal Complex (11) or (30) of the photographically useful compound for use in the present invention was added to each of the first, third and fifth layers in an amount of 0.2 mmol/$m^2$ to prepare Samples 302 and 303.

In the processing described in the patent publication above, the development processing with the processing solution where 3.0 g of ethylenediaminetetraacetic acid added to the color developer only was replaced by 8.4 g of 2,6-pyridinedi-carboxylic acid was designated as Processing A and the development processing with the processing solution described in the publication was designated as Processing B.

Samples 301 to 303 each was wedgewise exposed in the same manner as in Example 1, subjected to Processing A for the development time of 30 seconds, 40 seconds or 45 seconds or to Processing B for the development time of 45 seconds, and thereafter processed in the same manner as described in the publication. As a result of comparison between the characteristic curves obtained, when Samples 302 and 303 containing the compound for use in the present invention were subjected to Processing A, the development acceleration effect in the short-time processing was observed. Thus, the method of the present invention was effective also on the color printing paper.

EXAMPLE 7

Heat development color diffusion transfer as described in Example of JP-A-7-219184 was performed. At this time, in place of the electron transfer agent used in the Example, Metal Complex (28) of the photographically useful compound for use in the present invention was used and then, a good image was obtained. This reveals that the water-soluble chelating agent transferred from the image-receiving material reacted with the metal complex of the photographically useful compound for use in the present invention to produce a more active photo- graphically useful compound (in this Example, an electron transfer agent).

According to the present invention, a desired photographically useful compound can be swiftly produced on development. Further, a reducing agent which is usually unstable to air oxidation and difficult of incorporation into the light-sensitive material, can be stably incorporated into the light-sensitive material according to the method of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having provided thereon a light-sensitive silver halide emulsion layer, wherein said silver halide photographic light-sensitive material contains a compound having been blocked by a metal chelate and capable of releasing a photographically useful compound therefrom through a reaction of the metal chelate moiety with a water-soluble chelating agent capable of forming a metal chelate having a higher stability constant on development, wherein said compound having been blocked by the metal chelate and capable of releasing the photographically useful compound therefrom is represented by the following formula (I):

$$(PL)_n \cdot M \cdot L_k \qquad (I)$$

wherein PL represents a photographically useful group having chelating ability, M represents magnesium, aluminum, calcium, nickel, copper or zinc, L represents a chelate ligand, n represents an integer of from 1 to 3, K represents 0 or an integer of 1 or 2, and the sum of n and k does not exceed 3.

2. The silver halide photographic light-sensitive material as claimed in claim 1, wherein a metal in said metal chelate is magnesium, aluminum, calcium, nickel, copper or zinc.

3. The silver halide photographic light-sensitive material as claimed in claim 1, wherein said photographically useful compound is a developing agent, an auxiliary developing agent, a fogging agent or a development accelerator.

4. The silver halide photographic light-sensitive material as claimed in claim 1, wherein said water-soluble chelating agent is a nitrogen-containing heterocyclic carboxylic acid.

5. The silver halide photographic light-sensitive material as claimed in claim 1, wherein the compound represented by formula (I) is a compound represented by the following formula (II):

$$(PUG\text{-}LINK\text{-}LIG)_n \cdot M \cdot L_k \qquad (II)$$

wherein PUG represents a photographically useful group, LINK represents a single bond or a divalent linking group, LIG represents a chelating group, M represents magnesium, aluminum, calcium, nickel, copper or zinc, L represents a chelate ligand, n represents an integer of from 1 to 3, k represents 0 or an integer of 1 or 2, and the sum of n and k does not exceed 3.

6. The silver halide photographic light-sensitive material as claimed in claim 2, wherein said metal is zinc.

7. The silver halide photographic light-sensitive material as claimed in claim 1, wherein M is zinc.

8. The silver halide photographic light-sensitive material as claimed in claim 5, wherein M is zinc.

9. The silver halide photographic light-sensitive material as claimed in claim 1, wherein PL is a developing agent residue, an auxiliary developing agent residue, a fogging agent residue, or a development accelerator residue.

10. The silver halide photographic light-sensitive material as claimed in claim 5, wherein PUG is a developing agent residue, an auxiliary developing agent residue, a fogging agent residue, or a development accelerator residue.

11. The silver halide photographic light-sensitive material as claimed in claim 1, wherein an atom of PL bonded to M is nitrogen or oxygen.

12. The silver halide photographic light-sensitive material as claimed in claim 5, wherein an atom of LIG bonded to M is nitrogen or oxygen.

13. The silver halide photographic light-sensitive material as claimed in claim 1, wherein formula (I) is

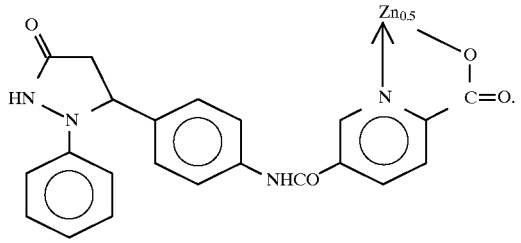

14. A silver halide photographic light-sensitive material comprising a support having provided thereon a light-sensitive silver halide emulsion layer, wherein said silver halide photographic light-sensitive material contains a compound having been blocked by a metal chelate and capable of releasing a photographically useful compound therefrom through a reaction of the metal chelate moiety with a water-soluble chelating agent capable of forming a metal chelate having a higher stability constant on development, wherein said compound having been blocked by the metal chelate and capable of releasing the photographically useful compound therefrom is represented by the following formula (I):

$$(PL)_n \cdot M \cdot L_k \quad \text{(I)}$$

wherein PL represents a photographically useful group having chelating ability, M represents magnesium, aluminum, calcium, nickel, copper or zinc, L represents a chelate ligand, n represents an integer of 1 or 2, and the sum of n and k does not exceed 3, and wherein said chelating group in said photographically useful compound is a multidentate ligand.

15. The silver halide photographic light-sensitive material as claimed in claim 14, wherein said multidentate ligand is a bidentate ligand.

16. A method for forming an image comprising processing, after imagewise exposure, a silver halide photographic light-sensitive material with a processing solution containing a nitrogen-containing heterocyclic carboxylic acid-base chelating agent, wherein said silver halide photographic light-sensitive material comprises a support having provided thereon a light-sensitive silver halide emulsion layer, wherein said silver halide photographic light-sensitive material contains a compound having been blocked by a metal chelate and capable of releasing a photographically useful compound therefrom through a reaction of the metal chelate moiety with a water-soluble chelating agent capable of forming a metal chelate having a higher stability constant on development, wherein said compound having been blocked by a metal chelate and capable of releasing a photographically useful compound therefrom the compound is represented by the following formula (I):

$$(PL)_n \cdot M \cdot L_k \quad \text{(I)}$$

wherein PL represents a photographically useful group having chelating ability, M represents magnesium, aluminum, calcium, nickel, copper or zinc, L represents a chelate ligand, n represents an integer of from 1 to 3, k represents 0 or an integer of 1 or 2, and the sum of n and k does not exceed 3.

17. The method for forming the image as claimed in claim 16, wherein M is zinc.

18. The method for forming the image as claimed in claim 16, wherein PL is a developing agent residue, an auxiliary developing agent residue, a fogging agent residue, or a development accelerator residue.

19. The method for forming an image as claimed in claim 16, wherein formula (I) is.

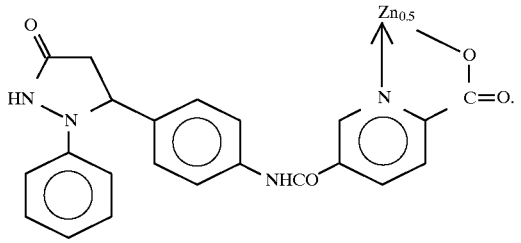

20. A method for forming an image comprising processing, after imagewise exposure, a silver halide photographic light-sensitive material with a processing solution containing a nitrogen-containing heterocyclic carboxylic acid-base chelating agent, wherein said silver halide photographic light-sensitive material comprises a support having provided thereon a light-sensitive silver halide emulsion layer, wherein said silver halide photographic light-sensitive material contains a compound having been blocked by a metal chelate and capable of releasing a photographically useful compound therefrom through a reaction of the metal chelate moiety with a water-soluble chelating agent capable of forming a metal chelate having a higher stability constant on development, wherein said compound having been blocked by a metal chelate and capable of releasing a photographically useful compound therefrom the compound is represented by the following formula (II):

$$(PUG\text{-}LINK\text{-}LIG)_n \cdot M \cdot L_k \quad \text{(II)}$$

wherein PUG represents a photographically useful group, LINK represents a single bond or a divalent linking group, LIG represents a chelating group, M represents magnesium, aluminum, calcium, nickel, copper or zinc, L represents a chelate ligand, n represents an integer of from 1 to 3, k represents 0 or an integer of 1 or 2, and the sum of n an k does not exceed 3.

21. The method for forming the image as claimed in claim 20, wherein M is zinc.

22. The method for forming the image as claimed in claim 20, wherein PUG is a developing agent residue, an auxiliary developing agent residue, a fogging agent residue, or a development accelerator residue.

* * * * *